US007275352B2

(12) United States Patent
Autovino et al.

(10) Patent No.: US 7,275,352 B2
(45) **Date of Patent: *Oct. 2, 2007**

(54) FIRE RETARDANT PANEL DOOR AND DOOR FRAME HAVING INTUMESCENT MATERIALS THEREIN WITH A 90 MINUTE FIRE RATING

(75) Inventors: Enrico Autovino, Avenel, NJ (US); James W. Jelinski, Avenel, NJ (US)

(73) Assignee: Artistic Doors & Windows Inc., Avenel, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/124,504

(22) Filed: May 6, 2005

(65) Prior Publication Data

US 2006/0248833 A1 Nov. 9, 2006

(51) Int. Cl.
*E04C 2/54* (2006.01)
*E04C 2/00* (2006.01)
*E06B 3/70* (2006.01)

(52) U.S. Cl. ..... 52/784.11; 52/455; 52/232

(58) Field of Classification Search ..... 49/1–8, 49/501; 52/1, 232, 455, 656.2, 656.3, 656.4, 52/779, 784.1, 784.11, 784.13, 784.15, 787.11, 52/794.1; 292/DIG. 66

See application file for complete search history.

(56) References Cited

U.S. PATENT DOCUMENTS 786,593 A * 4/1905 Ohnstrand ..... 52/784.12
2,910,739 A * 11/1959 Snitker ..... 49/504
3,426,491 A * 2/1969 Breu et al. ..... 52/211
4,104,828 A * 8/1978 Naslund et al. ..... 49/399
4,265,068 A * 5/1981 Pomroy ..... 52/456
4,282,687 A * 8/1981 Teleskivi ..... 49/503
5,590,919 A * 1/1997 Germano ..... 292/137

(Continued)

*Primary Examiner*—Naoko Slack
*Assistant Examiner*—Ryan Kwiecinski
(74) *Attorney, Agent, or Firm*—Ezra Sutton

(57) ABSTRACT

A fire retardant panel door, including a panel door having at least one door panel and stiles and rails. The door panel includes an interior composite section formed by a first plurality of layers of intumescent materials and a first plurality of layers of fire resistant materials disposed between and laminated to a first pair of outer coverings to form a composite laminated door panel. Each of the stiles includes a first core formed of an incombustible material and a second plurality of layers of intumescent materials and a second outer covering to form a composite laminated stile. Each of the rails includes a second core formed of an incombustible material and a third plurality of layers of intumescent materials and a third outer covering to form a composite laminated rail. The first, second, and third plurality of layers of intumescent materials are activated to expand upon exposure to heat and/or fire to prevent the heat and/or fire from passing through the at least one door panel, the stiles and the rails of the panel door during a fire for at least 90 minutes. The at least one door panel is connected to the panel door by joints; and the joints include a fourth plurality of layers each comprising intumescent and fire resistant materials, wherein the fourth plurality of layers of intumescent and fire resistant materials on the joints are activated to expand upon exposure to heat and/or fire to seal the joints in order to prevent the heat and/or fire from passing through the panel door during a fire for at least 90 minutes.

51 Claims, 17 Drawing Sheets

U.S. PATENT DOCUMENTS 6,643,991 B1 * 11/2003 Moyes ..... 52/784.11
6,745,526 B1 * 6/2004 Autovino ..... 52/232
2002/0124497 A1 * 9/2002 Fortin et al. ..... 52/232
2004/0226245 A1 * 11/2004 Clark et al. ..... 52/455
2005/0284030 A1 * 12/2005 Autovino et al. ..... 52/1
2006/0207199 A1 * 9/2006 Darnell ..... 52/232

* cited by examiner

320
A
P
384
386
388
20s
376
378
380
382
372
372/372'
376/376'
370/370'
374
390
404

FIRE RETARDANT PANEL DOOR AND DOOR FRAME HAVING INTUMESCENT MATERIALS THEREIN WITH A 90 MINUTE FIRE RATING

FIELD OF INVENTION

The present invention relates to a fire retardant panel door and door frame, and more particularly to a fire retardant panel door and door frame that provides fire resistance of at least 90 minutes using a plurality of intumescent and fire resistant barrier layers therein for preventing the spread of fire through the fire retardant panel door and door frame.

BACKGROUND OF THE INVENTION

A fire retardant panel door, often referred to as a "fire door," is installed in homes, commercial buildings, and industrial plants for preventing the passage or spread of fire from one part of the building to another. In the interest of public safety, standards have been set by governmental agencies; and by municipal, county and state building code authorities and insurance companies for the installation and performance of fire doors. The standards require that the fire retardant doors be installed in wall openings and that they pass industry-wide acceptance tests.

Standard test methods for fire door assemblies, such as ASTM E-152, UL 10(b) or NFPA 252, measure the ability of a door assembly to remain in an opening during a fire to retard the passage of the fire and evaluate the fire resistant properties of the door. In conducting such tests, doors are mounted in an opening of a fire proof wall. One side of the door is exposed to a predetermined range of temperatures over a predetermined period of time, followed by the application of a high pressure hose stream that causes the door to erode and provides a thermal shock to the assembly. Doors are given a fire rating based on the duration of the heat exposure of 20 minutes, 30 minutes, 45 minutes, 60 minutes (one hour), 90 minutes (1½ hours) or 180 minutes (three hours). The door assembly receives the fire rating when it remains in the opening for the duration of the fire test and hose stream, within certain limitations of movement and without developing openings through the door either at the core or around the edge material.

A fire door must be made almost entirely of incombustible material. However, since a fire door is part of the interior or exterior of a personal living space or workspace, it must also be aesthetically pleasing. Usually, therefore, a core of incombustible material comprising the main structure of the fire door is overlaid with a thin wood veneer facing that provides the door with an attractive appearance. Fire door assemblies often fail, not because of the fire resistant properties of the fire door, but they fail because of inadequate placement of the fire resistance materials within the door, such that the fire door buckles. Additionally, the fire resistant blocking material of a core section of the fire door may need supplemental fire resistant materials strategically placed within the fire door to add to its fire door rating.

There remains a need for a reinforced fire retardant panel door and door frame which provides additional fire resistance using layers of intumescent and fire resistant materials in the fire retardant panel door and door frame in order to prevent buckling of the fire retardant panel door and door frame during a fire for at least 90 minutes. Further, the reinforced fire retardant panel door would include supplemental layers of fire resistant materials strategically embedded within the structural components of the fire retardant panel door.

DESCRIPTION OF THE PRIOR ART

Fire retardant doors, and fire doors of various designs, configurations, structures and materials of construction have been disclosed in the prior art. For example, U.S. Pat. No. 6,115,976 to Gomez discloses an assembly for sealing a fire resistant door within a door frame during a fire event. The door edge assembly includes a plurality of door edges for receiving an intumescent strip within a slot on each door edge. The intumescent strip is constructed and designed to expand upon reaching a certain reaction temperature when exposed to a fire event or other extreme heat source. This prior art patent does not disclose or teach the particular door structure having the use of intumescent and fire resistant materials in the door panel, stiles, rails, door frame and door joints in order to provide for a fire retardant panel door that prevents buckling of the door during a fire, as well as prevent the spread of fire through the door and door frame for at least 90 minutes.

U.S. Pat. No. 5,816,017 to Hunt et al. discloses a fire retardant door and exit device for the fire retardant door. The fire retardant door includes a core of fire resistant-blocking material being Tectonite™ for providing the door with a fire rating of at least 90 minutes. The fire door uses intumescent material which expands when heated to fill the void in the channel between the channel walls and the vertical extending rods within the latch stile of the door. This prior art patent does not disclose or teach the particular door structure having the use of intumescent and fire resistant materials in the door panels, stiles, rails, door frame and door joints in order to provide for a fire retardant panel door that prevents buckling of the door during a fire, as well as prevents the spread of fire through the door and door frame for at least 90 minutes.

U.S. Pat. No. 5,417,024 to San Paolo discloses a fire resistant panel door. The fire resistant panel door is constructed from panels, stiles, intermediate rail and rails having a core of fire resistant material. The door components are joined together so that the fire resistant material extends substantially continuously from side to side and from top to bottom of the finished door. The fire resistant core of each door panel is recessed within the fire resistant core of the associated rails and stiles to reduce air infiltration through the door which can compromise the door's fire resistance. This prior art patent does not disclose or teach the particular door structure having the use of intumescent and fire resistant materials in the door panels, stiles, rails, door frame and door joints in order to provide for a fire retardant panel door that prevents buckling of the door and also prevents the passage of heat through the double door during a fire for at least 90 minutes.

U.S. Pat. No. 4,930,276 to Bawa et al. discloses a fire door window construction. The fire door includes a trim strip having inner and outer members. The inner member is of a high density incombustible mineral material or ceramic and is nailed in position to securely and uniformly hold the pane of glass in the door opening. The outer trim member is of a fire retardant particle board and has an exposed wood veneer facing throughout. An intumescent caulking compound is applied between an inner portion of the outer trim member and the pane of glass. This prior art patent does not disclose or teach the particular door structure having the use of intumescent and fire resistant materials in the door panels, stiles, rails, door frame and door joints in order to provide for a fire retardant panel door that prevents buckling of the door during a fire, as well as prevents the spread of fire through the door and door frame for at least 90 minutes.

U.S. Pat. No. 4,441,296 to Grabendike et al. discloses a fire resistant wood door structure designed to pass code and testing laboratories' requirements. The fire resistant wood door structure includes a door assembly having a support frame assembly with a panel assembly connected to the support frame assembly. The support frame assembly includes top, bottom, side, central and transverse frame members. The panel members include a main body connected through a peripheral edge by a double connector assembly. The double connector assembly functions to only remove about ⅓ of the door's normal 1¾ inch thickness during the burn testing procedure, thus passing the fire resistant testing of 20 minutes. This prior art patent does not disclose or teach the particular door structure having the use of intumescent and fire resistant materials in the door panels, stiles, rails, door frame and door joints in order to provide for a fire retardant panel door that prevents buckling of the door during a fire, as well as prevents the spread of fire through the door and door frame for at least 90 minutes.

U.S. Pat. Nos. 4,529,742; 6,031,040; and 6,153,674 all disclose the use of intumescent compounds/fire barrier materials within door construction to reduce or eliminate the passage of smoke and fire through the door and door frame. These prior art patents do not disclose or teach the particular door structure having the use of intumescent and fire resistant materials in the door panels, stiles, rails, door frame and door joints in order to provide for a fire retardant panel door that prevents buckling of the door during a fire, as well as prevents the spread of fire through the door and door frame for at least 90 minutes.

In addition, the aforementioned prior art patents do not disclose or teach the particular structure and configuration of the reinforced fire retardant panel door and door frame of the present invention that provides additional fire resistance to the door in order to prevent the buckling of the door during a fire.

Accordingly, it is an object of the present invention to provide a reinforced fire retardant panel door and door frame that prevents buckling of the door during a fire, and also prevents the passage of heat through the door for at least 90 minutes.

Another object of the present invention is to provide a reinforced fire retardant panel door and door frame that has supplemental fire resistant materials strategically embedded and placed within the tongue and groove joints of the fire resistant panel door, as well as supplemental fire resistant materials placed on the perimeter edges of the fire resistant panel door for preventing the spread of fire through the door and door frame.

Another object of the present invention is to provide a reinforced fire retardant panel door and door frame that has intumescent and fire resistant material layers within the panel door and door frame for preventing the spread of fire through the door and door frame.

Another object of the present invention is to provide a reinforced fire retardant panel door and door frame that has fire resistant materials being multiple layers of intumescent material that expands in the presence of fire such that the intumescent material closes and seals the component tongue and groove joints, as well as the perimeter edges of the fire retardant panel door for preventing the spread of fire through the door and door frame.

Another object of the present invention is to provide a reinforced fire retardant panel door and door frame that is used as part of an interior or exterior personal living space, or workspace being installed within home dwellings, commercial buildings or industrial plants.

Another object of the present invention is to provide a reinforced panel door and door frame that has improved aesthetic qualities by having minimum overall door panel thickness of 7⁄16 of an inch allowing for a thickness of 1¾ inches of the fire resistant and reinforced panel door which allows for greater profiling (depth) of the exterior wood molding between the center panel and the stiles and rails.

Another object of the present invention is to provide a reinforced fire retardant panel door and door frame that is aesthetically pleasing having the appearance of natural wood, and has achieved a successful fire rating of at least 90 minutes and passes a positive pressure test, and is easily installed in a building.

A further object of the present invention is to provide a reinforced fire retardant panel door and door frame that can be mass produced in an automated and economical matter and is readily affordable to the builder or consumer.

SUMMARY OF THE INVENTION

In accordance with the present invention, there is provided a fire retardant panel door for use in providing fire protection for a period of at least 90 minutes. The fire retardant panel door includes at least one door panel and stiles and rails. The door panel includes an interior composite section formed by a first plurality of layers of intumescent materials and a first plurality of layers of fire resistant materials disposed between and laminated to a first pair of outer coverings to form a composite laminated door panel. Each of the stiles includes a first core formed of an incombustible material and a second plurality of layers of intumescent materials and a second outer covering to form a composite laminated stile. Each of the rails includes a second core formed of an incombustible material and a third plurality of layers of intumescent materials and a third outer covering to form a composite laminated rail. The first, second, and third plurality of layers of intumescent materials are activated to expand upon exposure to heat and/or fire to prevent the heat and/or fire from passing through the at least one door panel, the stiles and the rails of the panel door during a fire for at least 90 minutes. The at least one door panel is connected to the panel door by joints; and the joints include a fourth plurality of layers each comprising intumescent and fire resistant materials, wherein the fourth plurality of layers of intumescent and fire resistant materials on the joints are activated to expand upon exposure to heat and/or fire to seal the joints in order to prevent the heat and/or fire from passing through the panel door during a fire for at least 90 minutes.

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

PREFERRED EMBODIMENT 100

Figure 1:
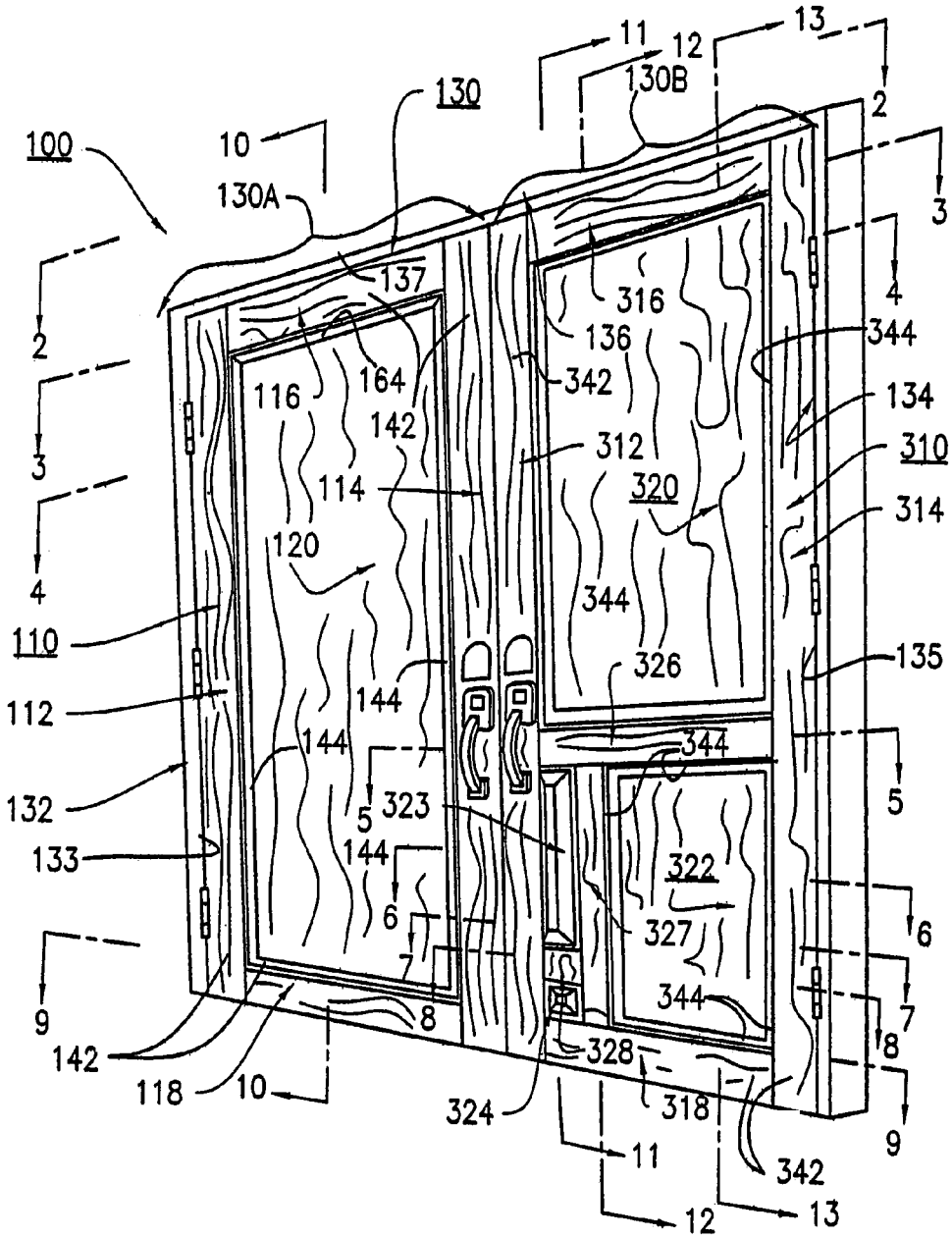
FIG. 1 is a front perspective view of the fire retardant panel door and door frame of the preferred embodiment of the present invention showing a double door assembly within a double door frame and its major component parts thereof.
Figure 2:
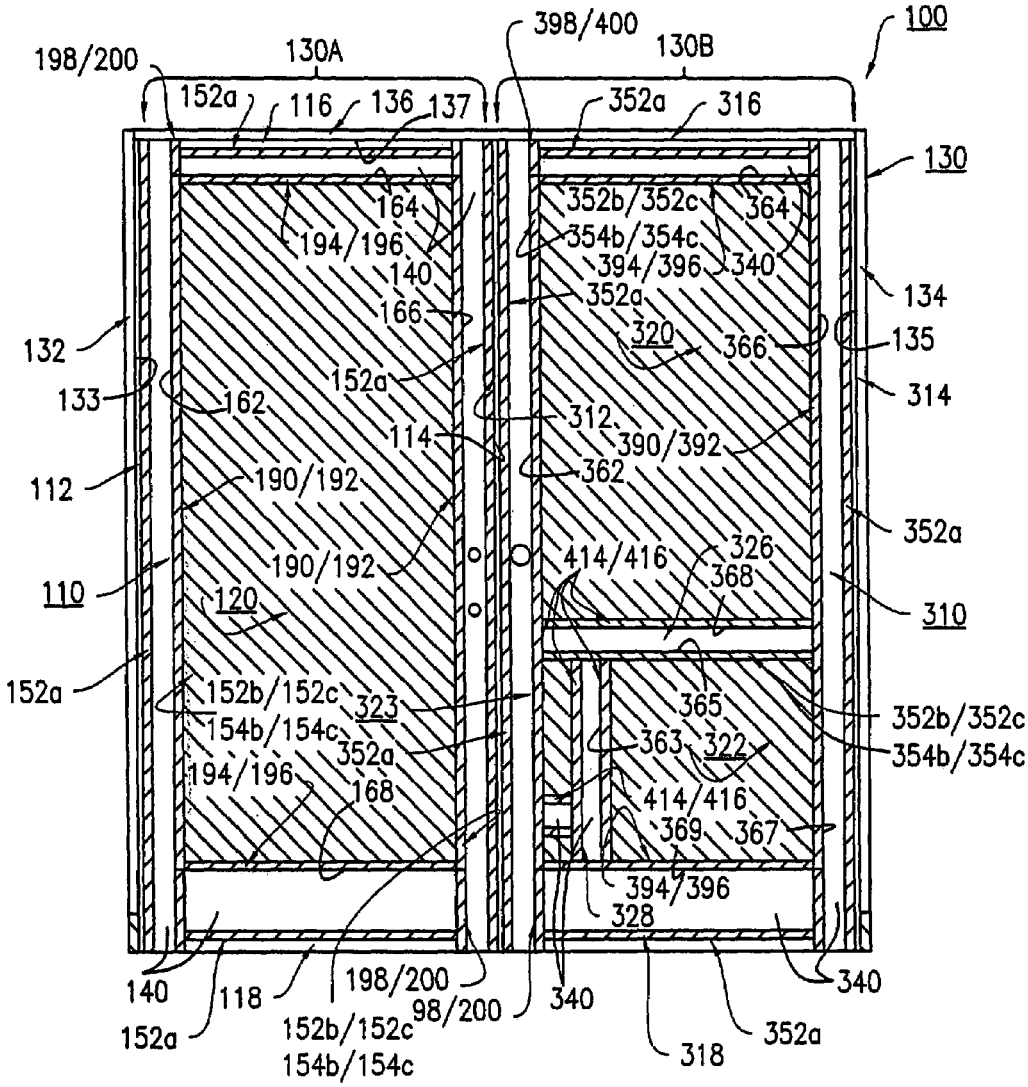
FIG. 2 is a cross-sectional view of the fire retardant panel door and door frame of the preferred embodiment of the present invention taken along lines 2—2 of FIG. 1 in the direction of the arrows showing intumescent materials within tongue and groove joints of a plurality of panels, stiles, rails, and intermediate rails within each of the doors of the double door assembly and intumescent materials within a double door frame.

A double door assembly 100 and door frame 130 of the second embodiment of the present invention is represented in detail by FIGS. 1 through 22 of the patent drawings. The double door assembly 100 includes a first fire retardant panel door 110, and a second fire retardant panel door 310 being hingedly connected to a double door frame 130. The first and second fire retardant panel doors 110 and 310, and double door frame 130 are used to fireproof an area and to prevent fire from spreading to other areas within a home dwelling, a commercial building, or an industrial plant. Fire retardant panel doors 110 and 310 are hingedly connected between a left and right door jambs 132 and 134 and positioned below an upper header 136, as depicted in FIGS. 1 and 2 of the drawings. Jambs 132 and 134 include an interior wall surface 133 and 135, respectfully and upper header 136 includes an interior wall surface 137.

Figure 3:
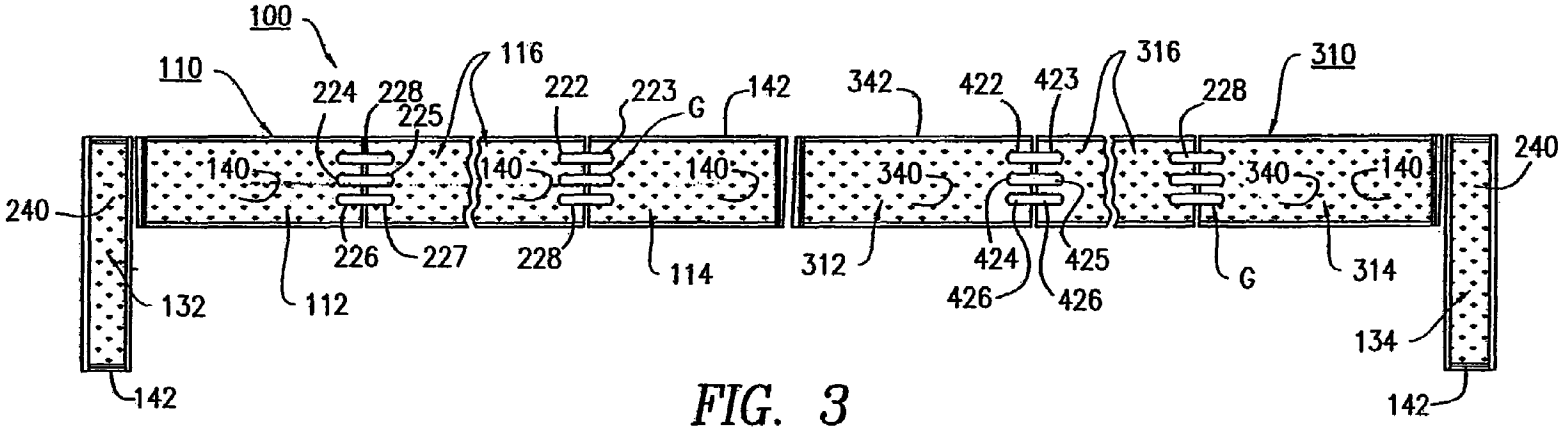
FIG. 3 is a cross-sectional view of the fire retardant panel doors and door frame of the present invention taken along lines 3—3 of FIG. 1 in the direction of the arrows showing each of the upper rails connected to opposing stiles for each door within the double door frame.
Figure 4:
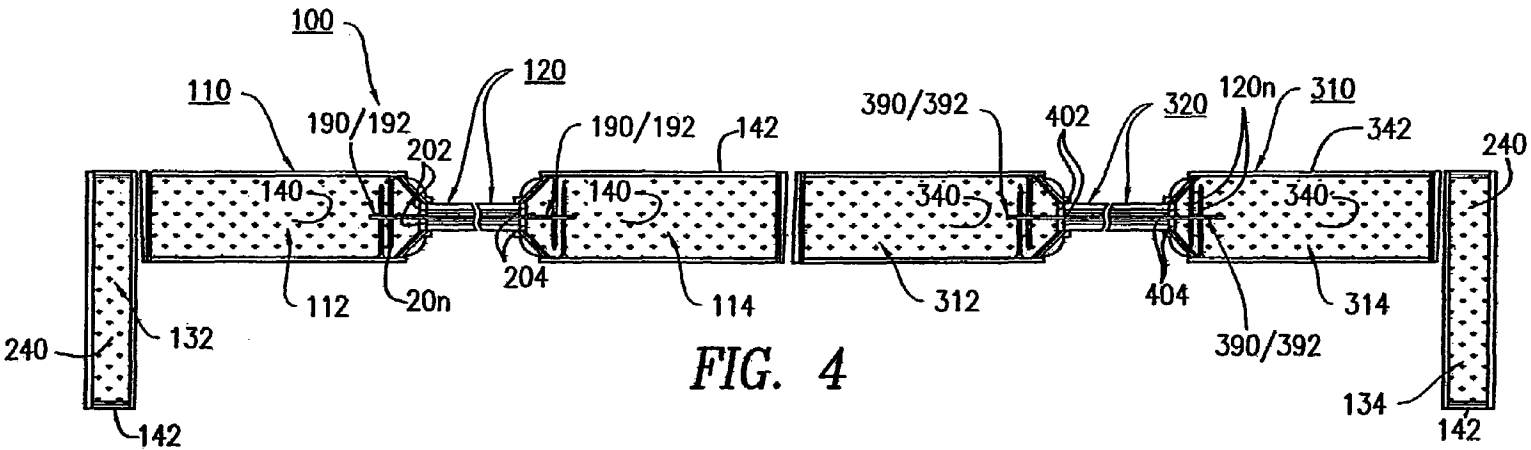
FIG. 4 is a cross-sectional view of the fire retardant panel doors and door frame of the present invention taken along lines 4—4 of FIG. 1 in the direction of the arrows showing each of the panels connected to opposing stiles for each door within the double door frame.

Fire retardant panel door 110 includes stiles 112 and 114, rails 116 and 118, and a center panel 120, as shown in FIGS. 1 through 4 and 9 through 20 of the drawings. The fire retardant panel door 110 is hingedly connected to one section 130A of the door frame 130, as depicted in FIGS. 1, 3, and 4, such that the panel door 110 is hingedly connected to the left door jamb 132 and positioned below section 130A of the upper header 136, as depicted in FIGS. 2, 3 and 4 of the drawings. As shown in FIGS. 3, 4, 9 and 10, the stiles 112 and 114 and rails 116 and 118 have a solid core section 140 formed of an incombustible material.

As shown in FIGS. 1, 3, 4, 9, 10 and 15, stile 112 includes wood applique layers 142*a*, 142*b*, 142*c*, 142*d* and 142*e*. Wood applique 142 is made from wood materials selected from the group consisting of oak, maple, walnut, popular, pine and other hardwoods. Wood applique layer 142*a* is adjacent and in contact a first intumescent layer 152*a*. Wood applique layer 142*b* and 142*c* are adjacent and in contact with solid core section 140. Wood applique layers 142*d* and 142*e* are adjacent and in contact with first intumescent layers 152*b* and 152*c*, respectively. First intumescent layers 152*b* and 152*c* are adjacent and in contact with second intumescent layers 154*b* and 154*c*, respectively. Second intumescent layers 154*b* and 154*c* are adjacent and in contact with solid core section 140. Similarly, stile 114 and rails 116 and 118 are constructed in the same manner as stile 112.

Intumescent layers 152*a*, 152*b*, 152*c*, 154*b* and 154*c* are made of TECHNO FIRE 2000™ product being manufactured by the Technical Fibre Products Subsidiary in Newburg, N.Y., U.S.A. is an intumescent panel consisting essentially of a core having rockwool fibers with chopped strand glass fibre reinforcement and a small portion of organic binder. A coating of epoxy resin is applied to each side of the core which protect the composite intumescent panel from atmospheric influences of carbon dioxide, water and/or steam. The density of the composite intumescent laminate sheet end layers is in the range of 78.0 to 90.5 5 lbs/ft$^3$ (1250 to 1450 kg/m$^3$). The intumescent laminate end layers has a mximum thickness of 1.3 mm (0.0512 inches). The mass per unit area of the intumescent laminate end layers is in the range of 0.333 to 0.386 pounds per foot$^2$. The intumescent laminate end layers upon exposure to heat and/or fire has expansion ratio of 22:1 for imparting linear gap seals between the fire retardant panel doors 10 and 310 and door frame 130 in order to prevent the spread of excessive heat and/or fire through the fire retardant panel double door 100 and door frame sections 130A and 130B of door frame 130. The mass per unit area of each of the intumescent laminate (panel) layers 152*a*, 152*b*, 152*c*, 154*b* and 154*c* is in the range of 0.333 to 0.386 pounds per foot$^2$. The thickness of the intumescent laminate layers 152*a*, 152*b*, 152*c*, 154*b* and 154*c* is in the range 0.0590 inches to 0.0906 inches.

Wood molding 144 is applied to the exterior surface of stiles 112 and 114, rails 116 and 118, and center panel 120, as shown in FIG. 1 of the drawings, to perimeter edges 162, 164, 166 and 168, respectively. The aforementioned wood applique 142, intumescent layers 152*a*, 152*b*, 152*c*, 154*b* and 154*c*, and the solid core section 140 are laminated together under pressure P using an adhesive system A between layers consisting of a Resourcinol™ adhesive A or an equivalent adhesive in order to form the composite laminated stiles 112 and 114 and rails 116 and 118, respectively.

Figure 14:
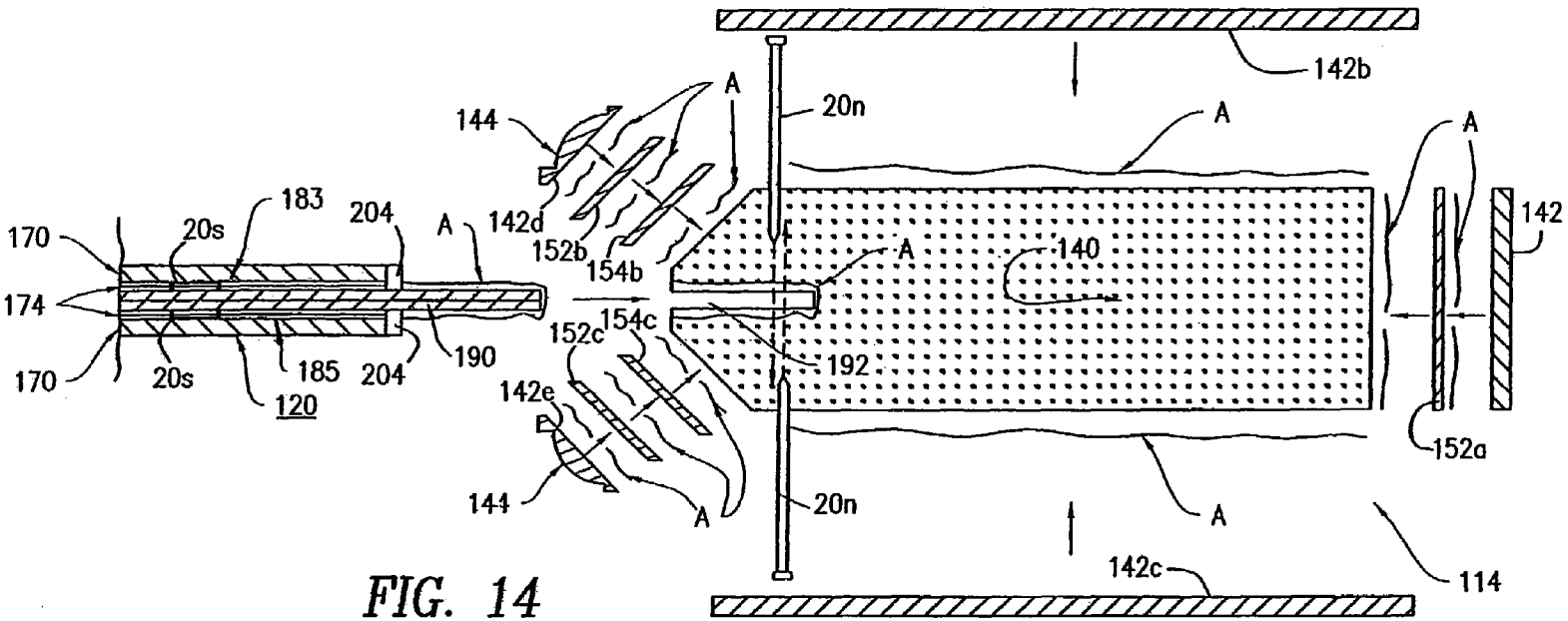
FIG. 14 is an enlarged exploded sectional detailed view of the fire retardant panel door of the present invention showing the upper rail having an exterior wood applique, a plurality of intumescent layers, a solid incombustible core, the center panel having an interior center composite section of intumescent layers and retardant barrier layers, and the tongue and groove joint for joining the center panel to the upper rail for the first door panel.
Figure 15:
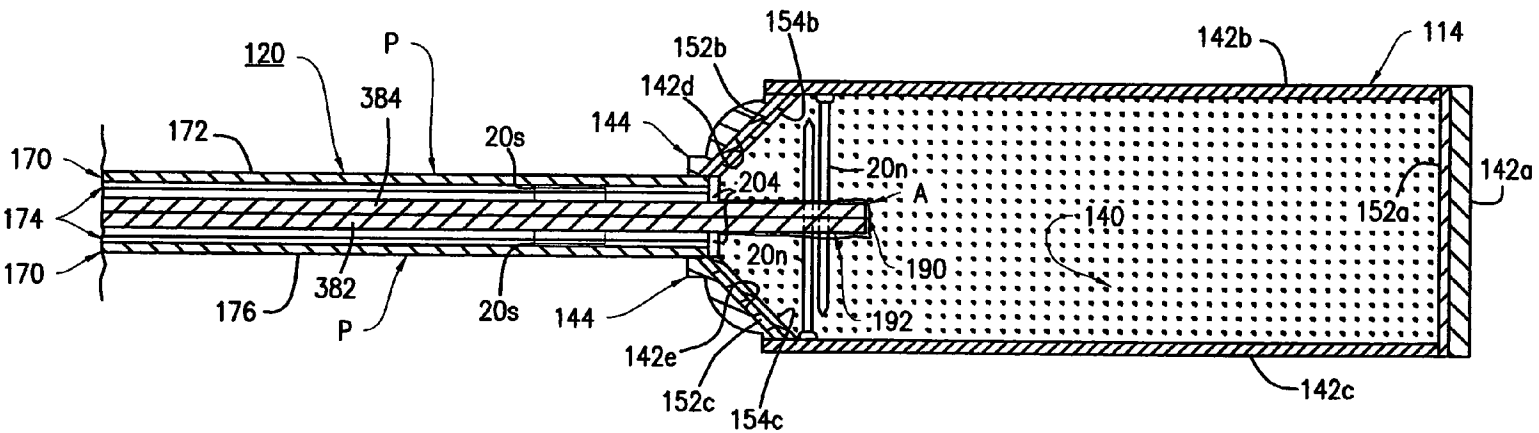
FIG. 15 is an enlarged sectional detailed view of the fire retardant panel door of the present invention showing the upper rail having the exterior wood applique, the plurality of intumescent layers, the solid incombustible core, the center panel having an interior center composite section of intumescent layers, and the tongue and groove joint for joining the center panel to the upper rail for the first panel door in an assembled configuration.
Figure 16:
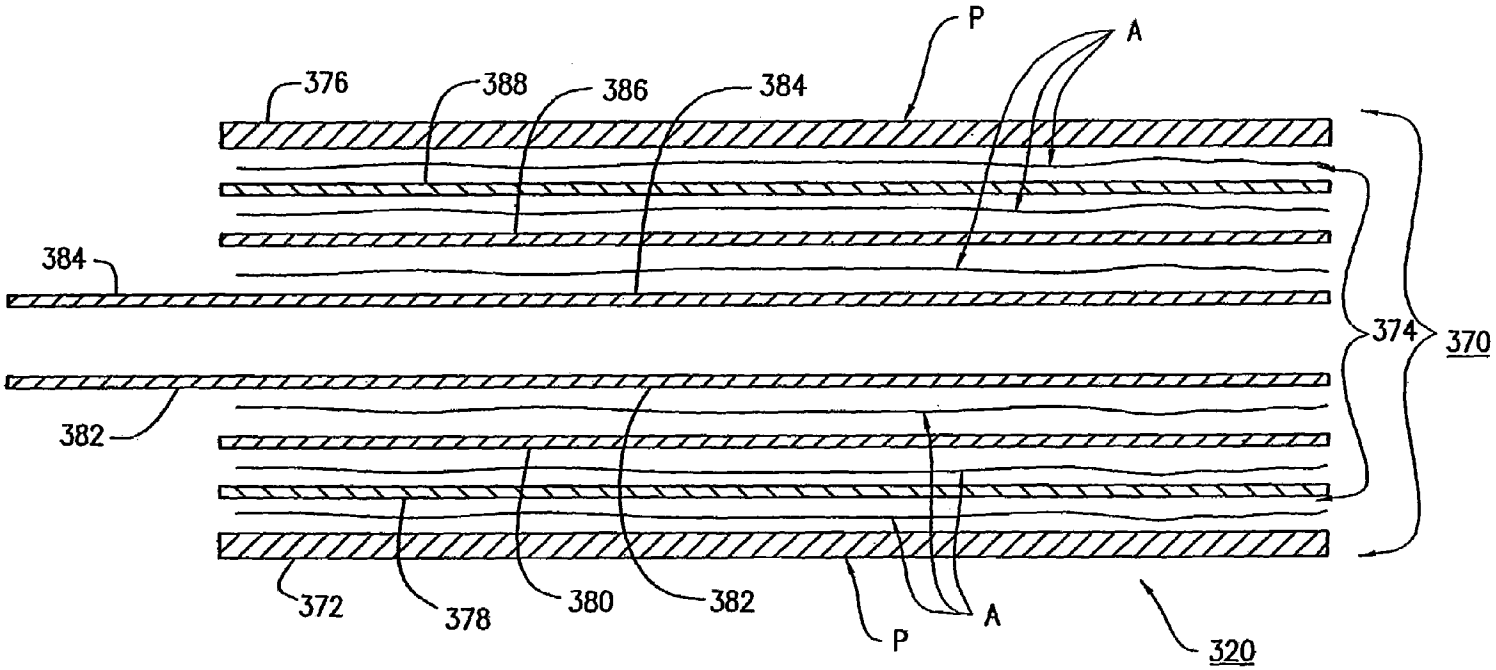
FIG. 16 is an exploded sectional detailed view of the fire retardant panel door of the present invention showing the center panel of the first door panel having exterior wood layers, and a plurality intumescent layers, a pair of fire retardant barrier layers for forming an interior center composite section.
Figures 17, 18, 19:
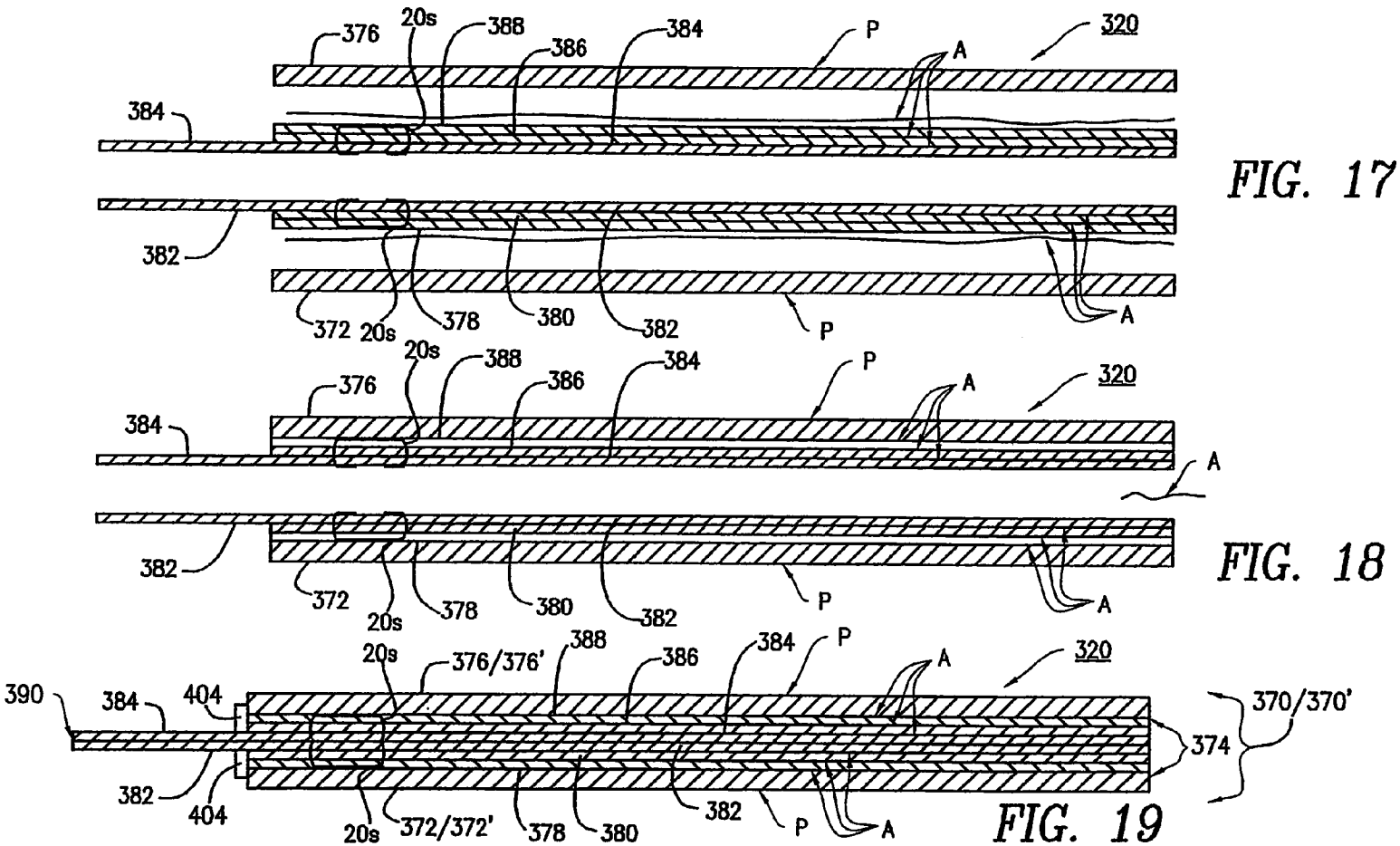
FIG. 17 is a partial exploded sectional detailed view of the fire retardant panel door of the present invention showing the exterior wood layers being connected and laminated by adhesive material to opposing sections of intumescent layers and the fire retardant barrier layer stapled with each other.
FIG. 18 is a partial exploded sectional detailed view of the fire retardant panel door of the present invention showing the opposing sections of the exterior wood layer, the intumescent layers, the fire retardant barrier layer being connected and laminated with each other to form the center panel.
FIG. 19 is a sectional detailed view of the fire retardant panel door of the present invention showing the composite center panel in its laminated and assembled configuration.
Figure 20:
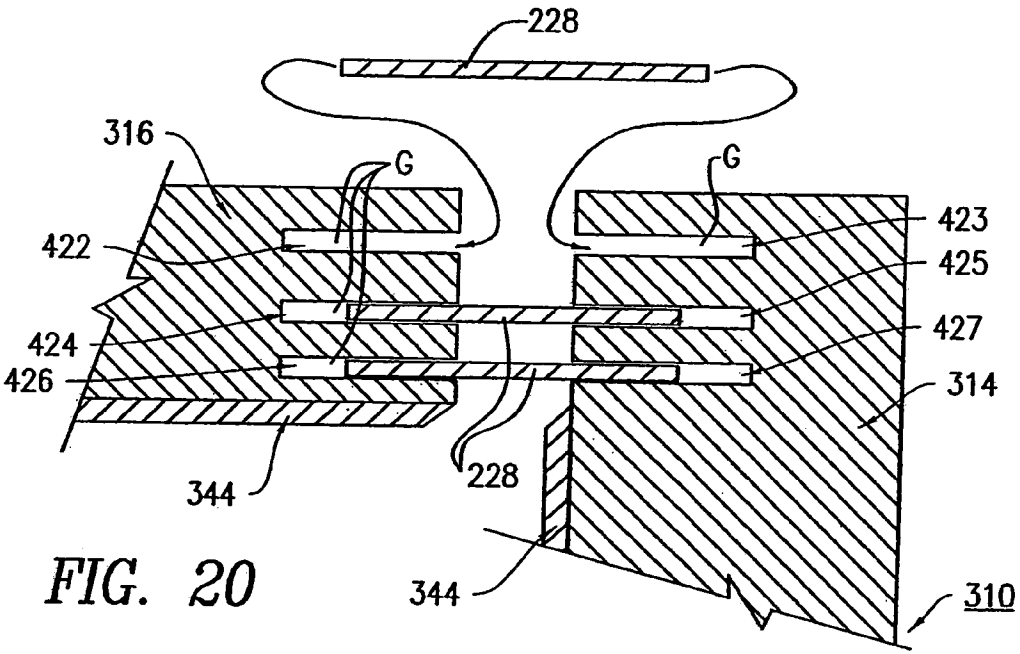
FIG. 20 is an exploded sectional detailed view of the fire retardant panel door of the present invention showing the upper rail being joined to the stile by a plurality of dowels within a plurality of dowel channels by glue to form an outside corner of the second door panel.

The center panel 120 is formed from a composite laminate structure 170. The composite laminate structure 170 includes outer wood sections 172 and 176 and sandwiched there between is an interior center intumescent section 174, as depicted in FIGS. 15 to 19 of the patent drawings. The interior center composite intumescent section 174 includes a first outer intumescent layer 178, a second inner intumescent layer 180, a third middle fire resistant barrier layer 182, a fourth middle fire resistant barrier layer 184, a fifth inner intumescent layer 186, a sixth outer intumescent layer 188. The first outer, second inner, fifth inner and sixth outer intumescent layers 178, 180, 186, and 188 are made of the PALUSOL™ P-210 product, as previously described. The third and fourth inner fire resistant barrier layers 182 and 184, are made of the FYRE ROC™ fire resistant barrier laminate sheet. Prior to the lamination of layers 178 to 188 under pressure, and a plurality of metal fasteners or staples 120*s* are used to connect each of the intumescent and fire resistant barrier layers 178, 180 and 182 together and connected of the intumescent and fire resistant barrier layers 184, 186 and 188 together, as shown in FIGS. 17, 18 and 19. The aforementioned outer wood sections 172, 176 and the intumescent and fire resistant barrier layers 178, 180, 182, 184, 186, and 188 are laminated together under pressure P using an adhesive system between layers consisting of Simpson ISR 70-07 isocyanate adhesive A or an equivalent adhesive in order to form the composite laminated center panel 174. In an alternate design, the composite laminate structure 174 is formed by two separate sections 183 and 185 of layers 178, 180 and 182; and layers 184, 186 and 188, respectively, wherein each of these sections 183 and 185 being separately stapled 120*m* and glued together using an adhesive A, as depicted in FIGS. 14 and 15 of the drawings. Layers 182 and 184 may also be glued together using an adhesive A, or left as separate unglued sections 183 and 185.

In a further alternate design, the composite laminate structure 170' includes outer covering sections 172' and 176' made of metal materials such as steel, stainless steel, aluminum and the like.

The inner fire resistant barrier layers are made of FYRE ROCT™ (FR-1001) product being manufactured by the Goodrich Corporation, Engineered Polymer Products Division, of Jacksonville, Fla., U.S.A. The FYRE ROC™ panel is a laminate sheet consisting of a fire resistant metallo alumino silicate and stainless steel screen layers for foming a reinforced composite laminate sheet that has the ability to maintain excellent mechanical and physical properties at elevated temperatures up to 2000 degrees Fahrenheit, without significant smoke or toxicity emissions. The density of the laminate fire resistant barrier (sheet) layers 178 to 188 are 2.5±0.5 grams per cubic centimeter. The thickness of the laminate fire resistant barrier layers 178 to 188 are in the range of 0.020 to 0.050 inches (due to reinforcement thickness variability).

Figure 5:
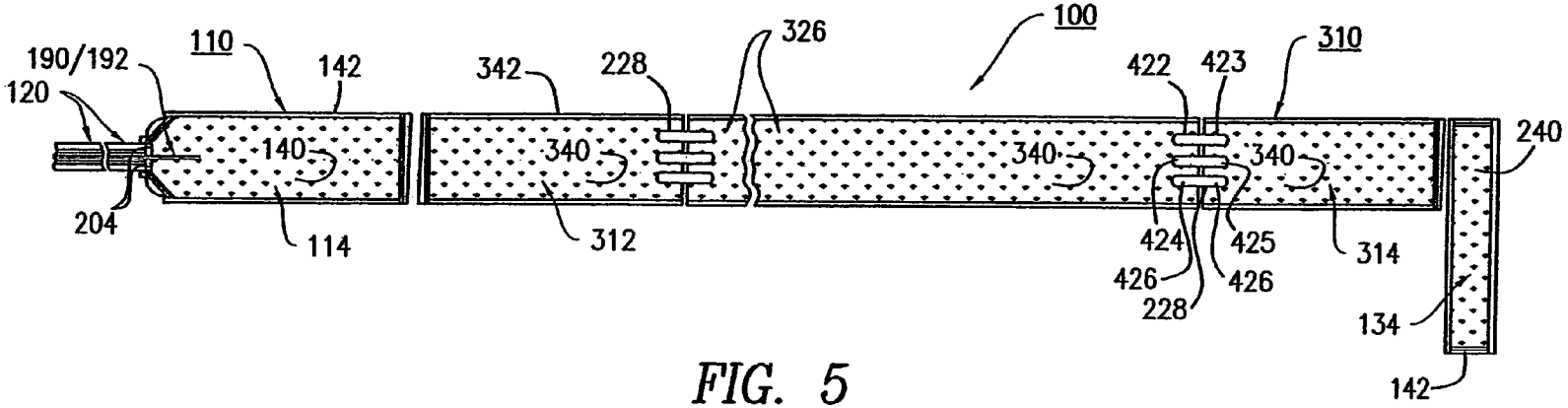
FIG. 5 is a cross-sectional view of the fire retardant panel doors and door frame of the present invention taken along lines 5—5 of FIG. 1 in the direction of the arrows showing a first intermediate rail connected to opposing stiles for the second door within the double door frame.
Figure 6:
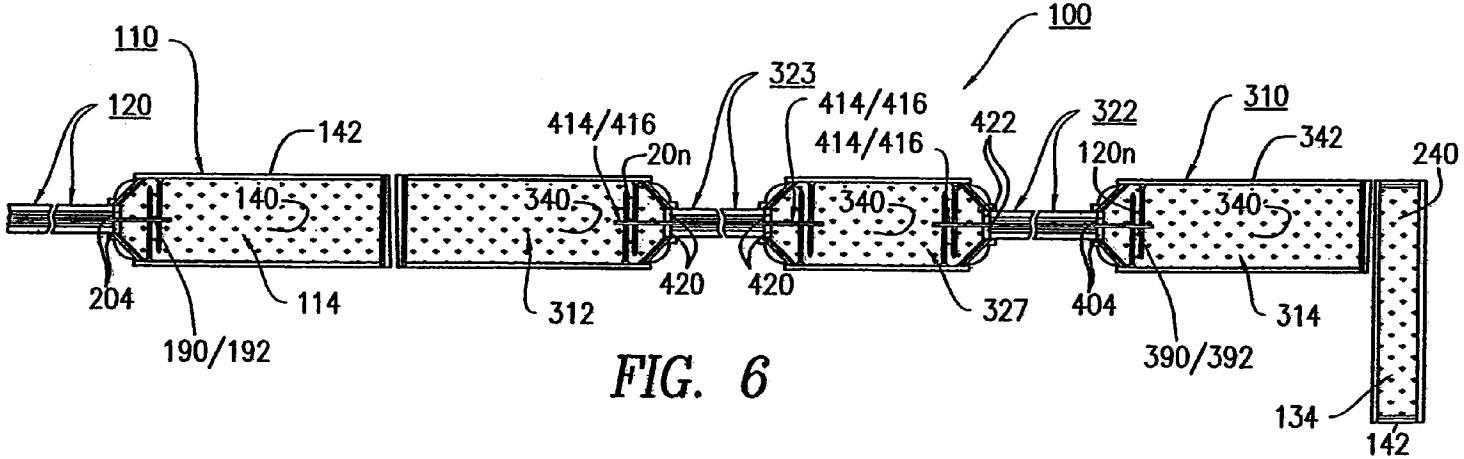
FIG. 6 is a cross-sectional view of the fire retardant panel door and door frame of the present invention taken along lines 6—6 of FIG. 1 in the direction of the arrows showing a lower panel, an interior first raised panel, an interior second intermediate rail, and the opposing stiles of one of the doors being set within the door frame.
Figure 9:
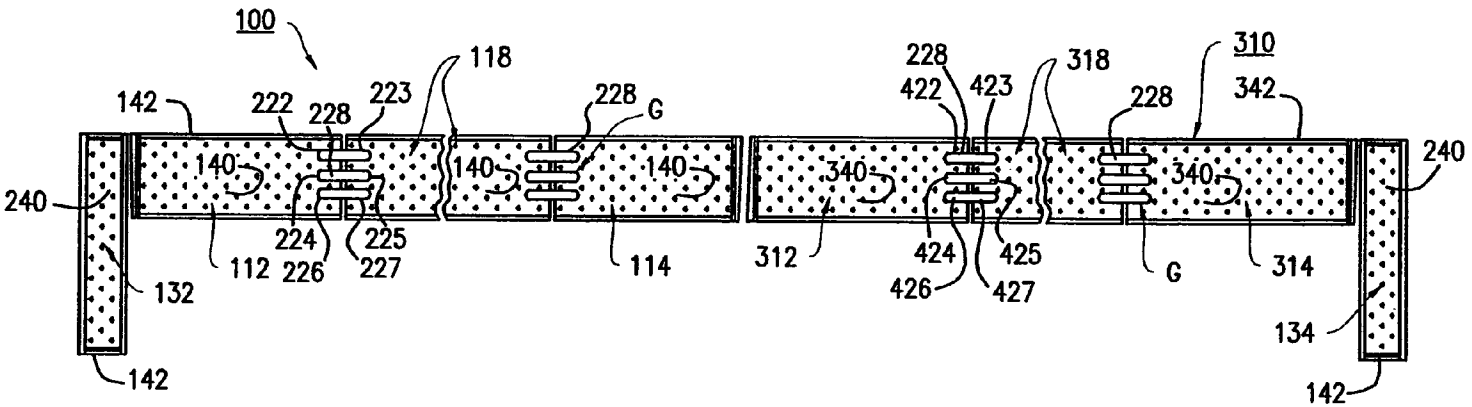
FIG. 9 is a cross-sectional view of the fire retardant panel doors and door frame of the present invention taken along lines 9—9 of FIG. 1 in the direction of the arrows showing each of the lower rails connected to opposing stiles for each door within the double door frame.
Figure 10:
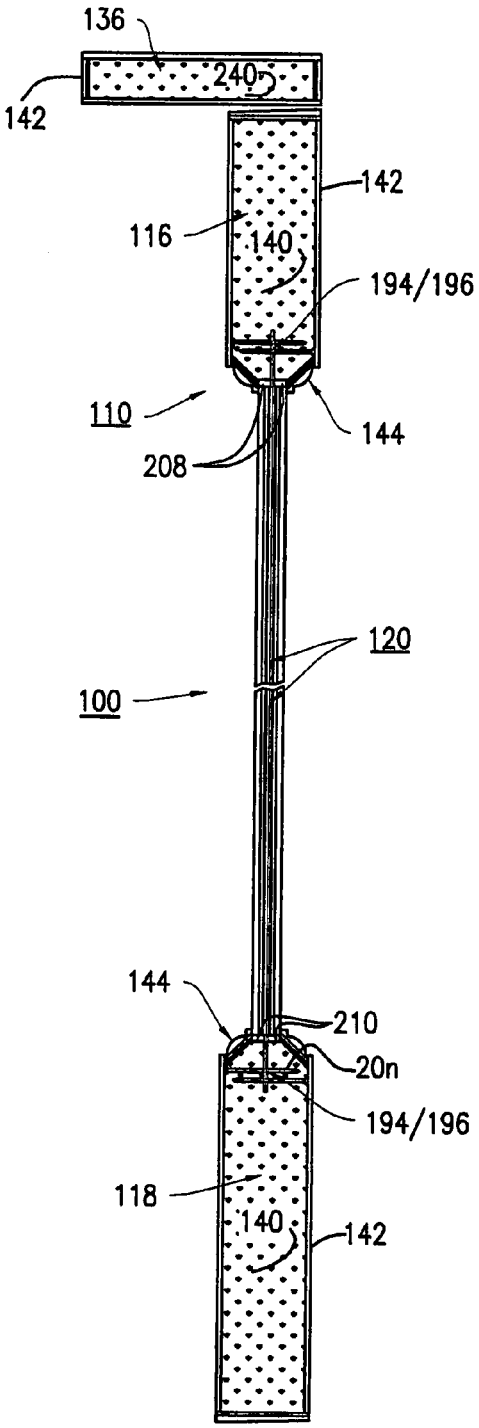
FIG. 10 is a cross-sectional view of the fire retardant panel door and door frame of the present invention taken along lines 10—10 of FIG. 1 in the direction of the arrows showing the panel connected to opposing rails of the first door within the double door frame.
Figure 22:
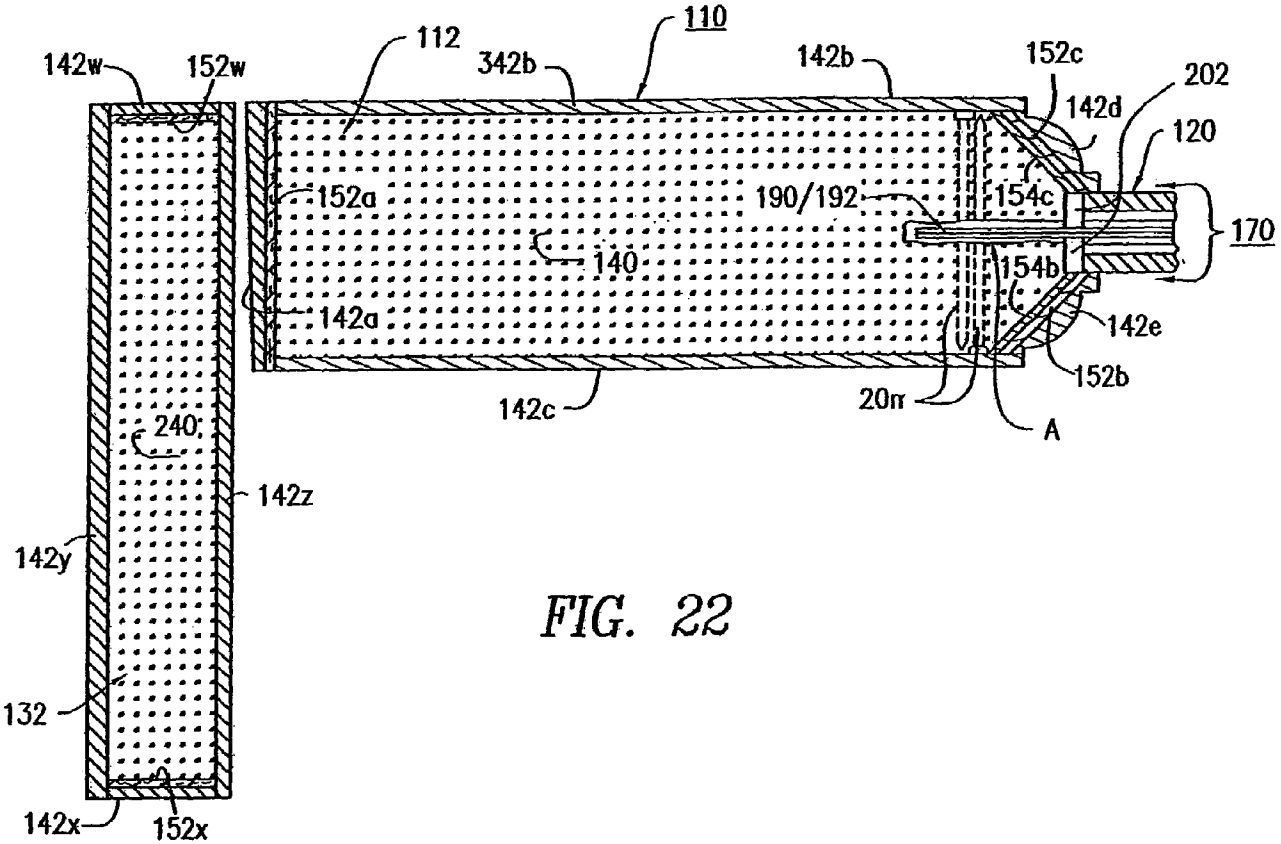
FIG. 22 is an enlarged sectional detailed view of the fire retardant panel door of the present invention showing the left stile of the first panel door having the exterior wood applique, the plurality of intumescent layers and the solid incombustible core, and the left jamb of the first panel door having the exterior wood applique, the plurality of intumescent layers and the solid incombustible core.

Tongue and groove joints 190 and 192 are used to connect center panel 120 to stiles 112 or 114, respectively, and tongue and groove joints 194 and 196 are used to connect center panel 120 to rails 116 or 118, respectively, as depicted in FIGS. 4, 6, 8, 10 and 15 of the drawings. As shown in FIG. 4, the tongue and groove joints 190 and 192 include air gaps 202 and 204 for expansion and contraction of the door 110, as well as of the intumescent material layers 178, 180, 186 and 188 that in the presence of excessive heat and/or fire, such that the intumescent material layers 178, 180, 186 and 188 close and seal the air gaps 202 and 204 within the fire retardant panel door 110 in order to prevent the spread of excessive heat and/or fire through the fire retardant panel door 110 and door frame 130. Further, the tongue and groove joints 194 and 196, as depicted in FIG. 10, also include air gaps 208 and 210 for expansion of the intumescent material layers 178, 180, 186 and 188 in the presence of excessive heat and/or fire, such that the intumescent material layers 178, 180, 186 and 188 close and seal the air gaps 208 and 210 within the fire retardant panel door 110 in order to prevent the spread of excessive heat and/or fire through the fire retardant panel door 110 and door frame 130. Also, the tongue and groove joints 190 and 192, and 194 and 196 attached to each other using a staple 20*s* or nail 20*n*, respectively, as shown in FIGS. 15 and 22 of the drawings, as well as using Simpson ISR 70-07 adhesive in tongue members 190 and 194 within groove channels 192 and 196, respectively. Tongue members 190 and 194 are made from the third and fourth middle fire resistant barrier layers 182 and 184 (FYRE ROC™ fire resistant barrier intumescent laminate sheet). Further, each of the rails 116 and 118 and stiles 112 and 114 include a dowel groove 222, 223, 224, 225, 226 and 227 respectively, for receiving a plurality of brass dowels 228 therein. Dowels 228 are used for additionally joining together the rails 116 and 118 to the stiles 112 and 114, respectfully, as shown in FIGS. 3, 5 and 9 of the drawings. The dowels 228 are held in place within dowel grooves 222, 223, 224, 225, 226 and 227 with Resourcinol™ glue G, as depicted in FIGS. 3, 5 and 9.

Figure 21:
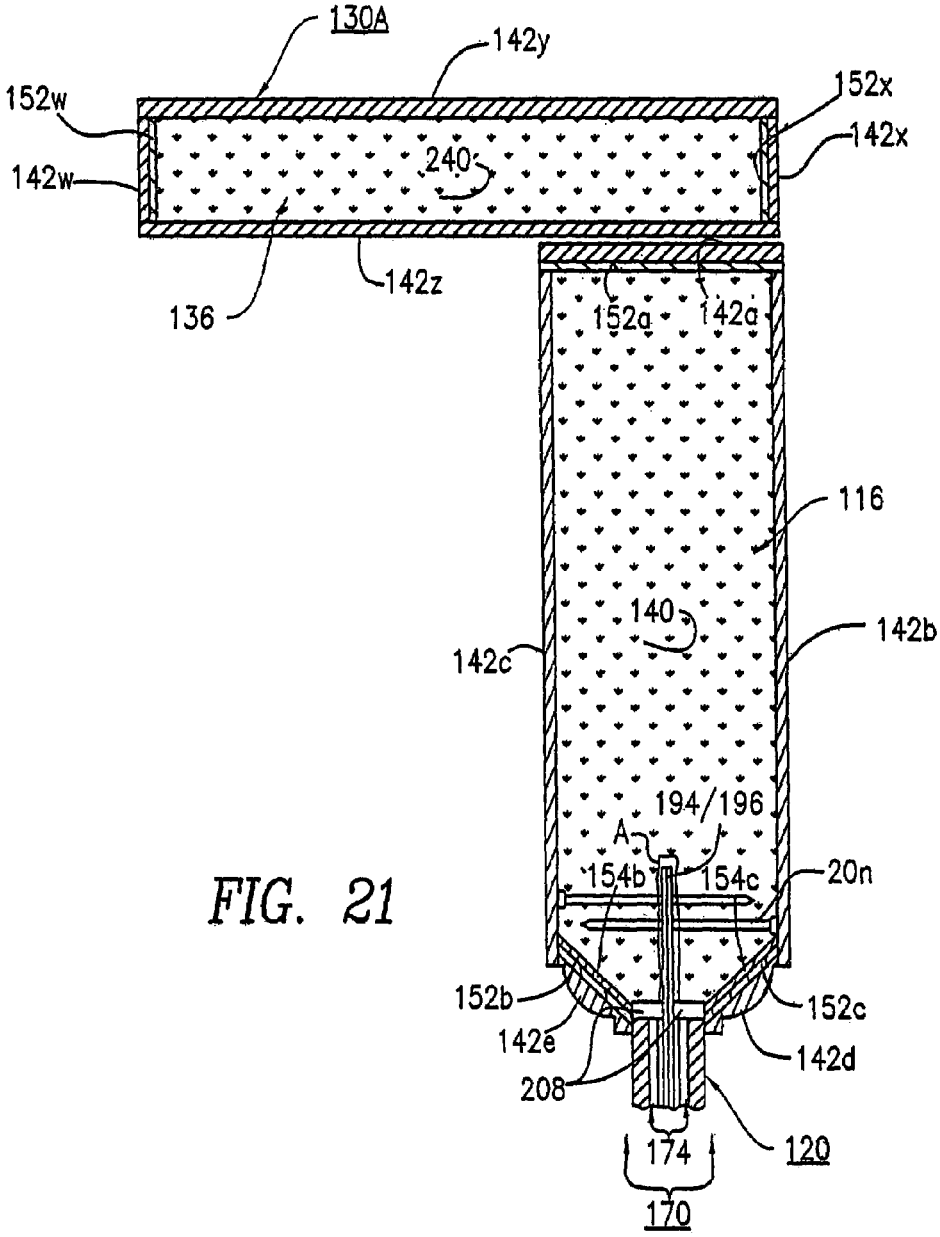
FIG. 21 is an enlarged sectional detailed view of the fire retardant panel door of the present invention showing the upper rail of the first panel door having the exterior wood applique, the plurality of intumescent layers and the solid incombustible core, and the upper header having the exterior wood applique, the plurality of intumescent layers and the solid incombustible core.
Figure 23:
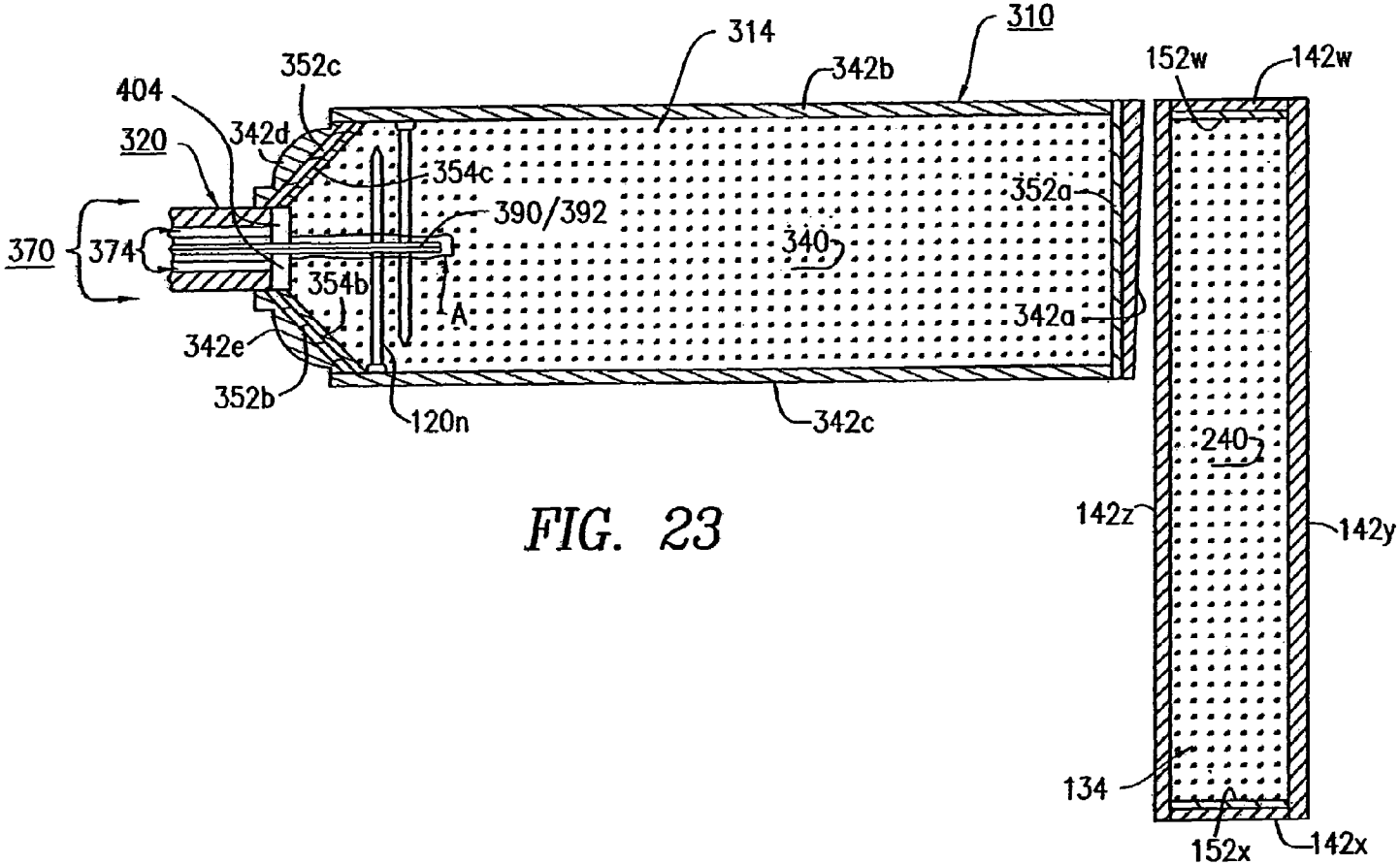
FIG. 23 is an enlarged sectional detailed view of the fire retardant panel door of the present invention showing the right stile of the second panel door having the exterior wood applique, the plurality of intumescent layers and the solid incombustible core, and the right jamb of the second panel door having the exterior wood applique, the plurality of intumescent layers and the solid incombustible core.

As shown in FIGS. 21, 22 and 23, the jambs 132 and 134, and upper head 136 of door frame 130 include a core section 240 formed of an incombustible material. As shown in FIGS. 21, 22 and 23, jamb 132 includes wood applique layers 142*w*, 142*x*, 142*y*, and 142*z*. Wood applique layers 142*w* and 142*x* are adjacent and in contact first intumescent layers 152*w* and 152*x*, respectively. Wood applique layer 142*y* and 142*z* are adjacent and in contact with solid core section 240. Similarly, jamb 134 and upper header 136 of door frame 130 are constructed in the same manner as jamb 132.

Fire retardant panel door 310 includes stiles 312 and 314, rails 316 and 318, an upper panel 320, a lower panel 322, a first raised panel 323, and a second raised panel 324, as shown in FIGS. 1 through 9 and 11 through 13 of the drawings. The fire retardant panel door 310 also includes a first intermediate rail 326 separating the upper panel 320 from the lower panel 322, a second intermediate rail 327 separating the lower panel 322 from the first raised panel 323, and a third intermediate rail 328 separating the first raised panel 323 from the second raised panel 324. The fire retardant panel door 310 is hingedly connected to the other section 130B of the door frame 130, as depicted in FIG. 1, such that the panel door 310 is hingedly connected to the right jamb 134 and positioned below a section 130B of the upper header 136, as depicted in FIGS. 2 and 21 of the drawings.

As shown in FIGS. 2, 5 and 6 through 9, the stiles 312 and 314, rails 316 and 318, and intermediate rails 326, 327, and 328 have solid core section 340 formed of an incombustible material. Stiles 312, and 314, rails 316 and 318 are constructed in the same manner as stiles 112 and 114 and rails 116 and 118, respectively, as shown in FIGS. 2, 15 and 23 of the drawings.

Figure 11:
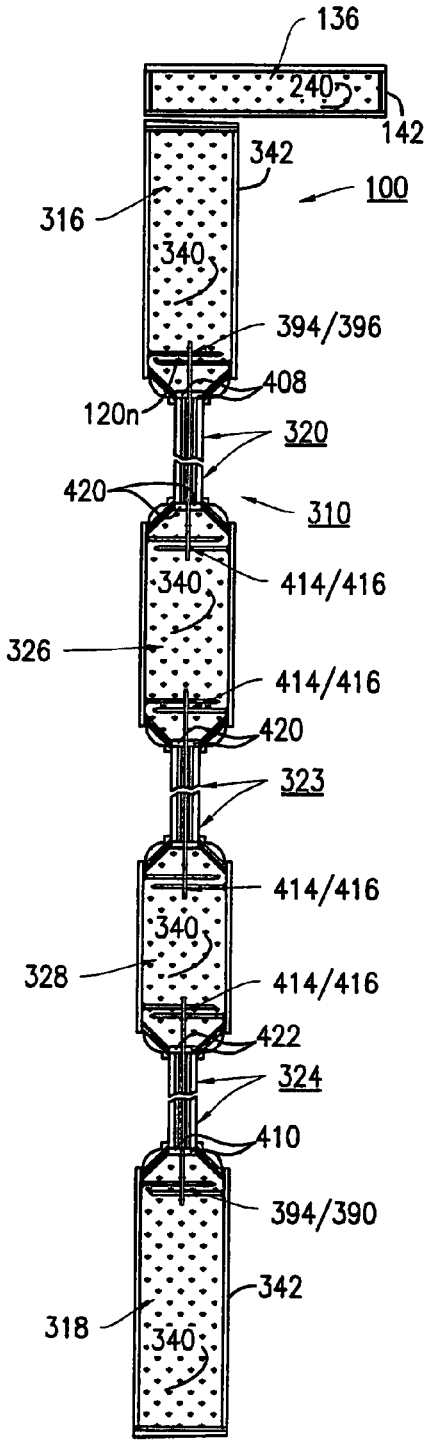
FIG. 11 is a cross-sectional view of the fire retardant panel door and door frame of the present invention taken along lines 11—11 of FIG. 1 in the direction of the arrows showing the panels connecting the opposite rails and the intermediate rails within the double door frame.
Figure 13:
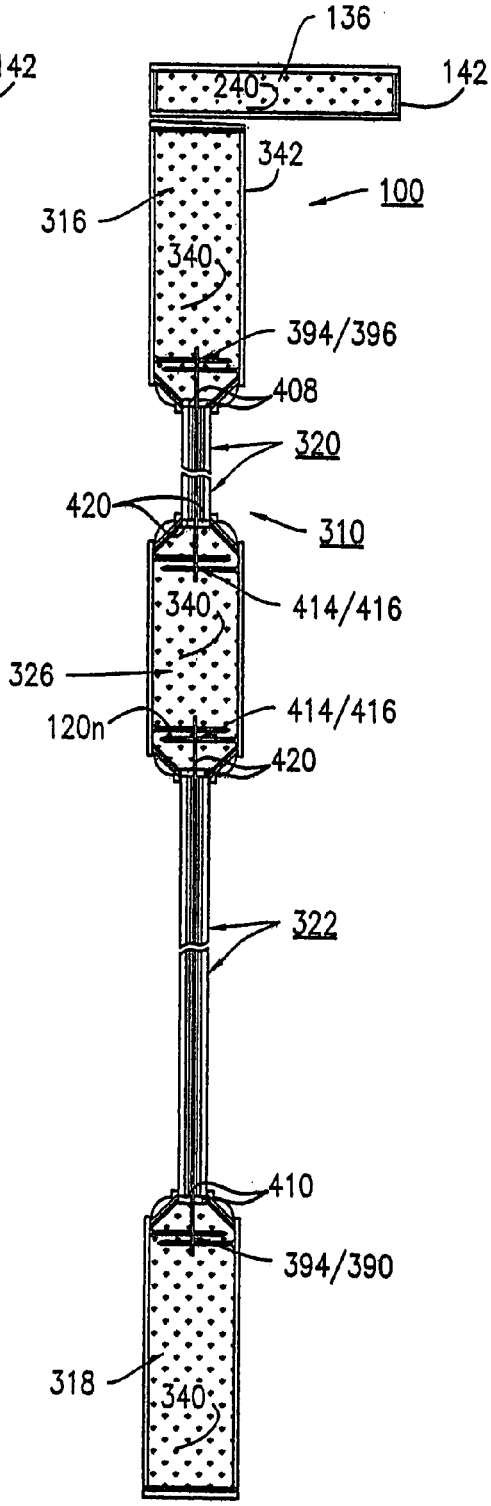
FIG. 13 is a cross-sectional view of the fire retardant panel door and door frame of the present invention taken along lines 13—13 of FIG. 1 in the direction of the arrows showing the upper and lower panels connecting the opposite rails and the first intermediate rails within the double door frame.
Figure 24:
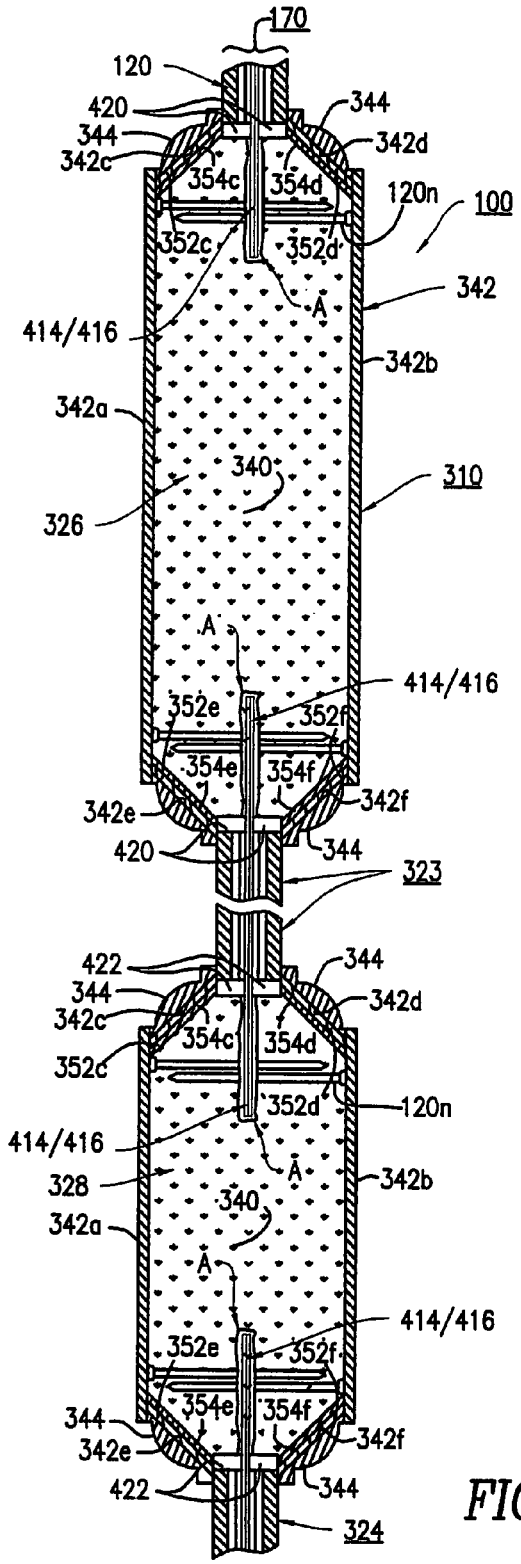
FIG. 24 is an enlarged sectional detailed view of the fire retardant panel door of the present invention showing the first and third intermediate rails of the second panel door each having the exterior wood applique, the plurality of the intumescent layers and the solid incombustible core.

As shown in FIGS. 11, 13 and 24, intermediate rail 326 includes wood applique layers 342*a*, 342*b*, 342*c*, 342*d* 342*e* and 342*f*. Wood applique layer 342*a* and 342*b* are adjacent and in contact with solid core section 340. Wood applique 342 is made from wood materials selected from the group consisting of oak, maple, walnut, popular, pine and other hardwoods. Wood applique layers 342*c*, 342*d*, 342*e* and 342*f* are adjacent and in contact with first intumescent layers 352*c*, 352*d*, 352*e* and 352*f* respectively. First intumescent layers 352*c*, 352*d*, 352*e* and 352*f* are adjacent and in contact with second intumescent layers 354*c*, 354*d*, 354*e* and 354*f*, respectively. Second intumescent layers 354*c*, 354*d*, 354*e* and 354*f* are adjacent and in contact with solid core section 340. Similarly, intermediate rails 327 and 328 are constructed in the same manner as intermediate rail 326.

Wood molding 344 is applied to the exterior surface of stiles 312 and 314, rails 316 and 318, intermediate rails 326, 327, and 328, and panels 320, 322, 323 and 324, as shown in FIGS. 1 and 24 of the drawings to perimeter edges 362, 364, 366 and 368, and to perimeter edges 363, 365, 367 and 369, respectively. The aforementioned wood applique 342, intumescent layers 352*c* to 352*f* and 354*c* to 354*f*, and the solid core section 340 are laminated together under pressure P using an adhesive system A between layers consisting of a Resourcinol™ adhesive A or an equivalent adhesive in order to form the composite laminated stiles 312 and 314, rails 316 and 318, and intermediate rails 326, 327 and 328, respectively, as depicted in FIGS. 23 and 24 of the drawings.

The panels 320, 322, 323, and 324 are formed from a composite laminate structure 370, as shown in FIGS. 13 to 18 and 21 of the drawings. The composite laminate structure 370 includes outer wood sections 372 and 376 and an interior center intumescent section 374 sandwiched therebetween. The interior center intumescent section 374 includes a first outer intumescent layer 378, a second inner intumescent layer 380, a third middle fire resistant barrier layer 382, a fourth middle fire resistant barrier layer 384 a fifth inner intumescent layer 386, and a sixth outer intumescent layer 388. The first outer, second inner, fifth inner, and sixth outer intumescent layers 378, 380, 386, and 388 are made of the PALUSOL™ P-210 product as previously described. The third and fourth fire resistant barrier layers 382 and 384 are made of the FYRE ROC™ fire resistant barrier laminate sheet, as previously described. The aforementioned outer wood sections 372, 376 and the intumescent and fire resistant barrier layer 378, 380, 382, 384, 386 and 388 are laminated together under pressure P using an adhesive system between layers consisting of a Simpson ISR 70-07 isocyanate adhesive A or an equivalent adhesive in order to form the composite laminated center panel 374, as shown in FIGS. 16 through 19 of the drawings. In an alternate design, the composite laminate structure 374 is formed by two separate sections 383 and 385 of layers 378, 380 and 382, and layers 384, 386 and 388, respectively, wherein each of these sections 383 and 385 being separately stapled 120*m* and glued together using an adhesive A, as depicted in FIGS. 16 through 19 of the drawings. Layers 382 and 384 may also be glued together using an adhesive A, or left as separate unglued sections 383 and 385.

In a further alternate design, the composite laminate structure 370' includes outer covering sections 372' and 376' made of metal materials such as steel, stainless steel, aluminum and the like.

Figure 7:
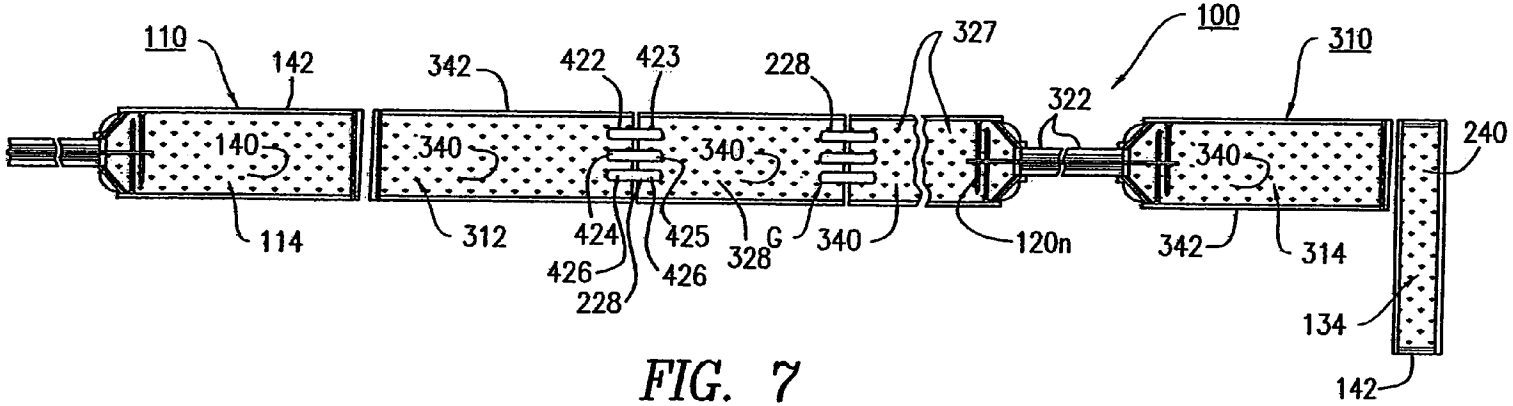
FIG. 7 is a cross-sectional view of the fire retardant panel door and door frame of the present invention taken along lines 7—7 of FIG. 1 in the direction of the arrows showing the lower panel, the interior second intermediate rail, an interior third intermediate rail, and the opposing stiles of one of the doors being set within the door frame.
Figure 8:
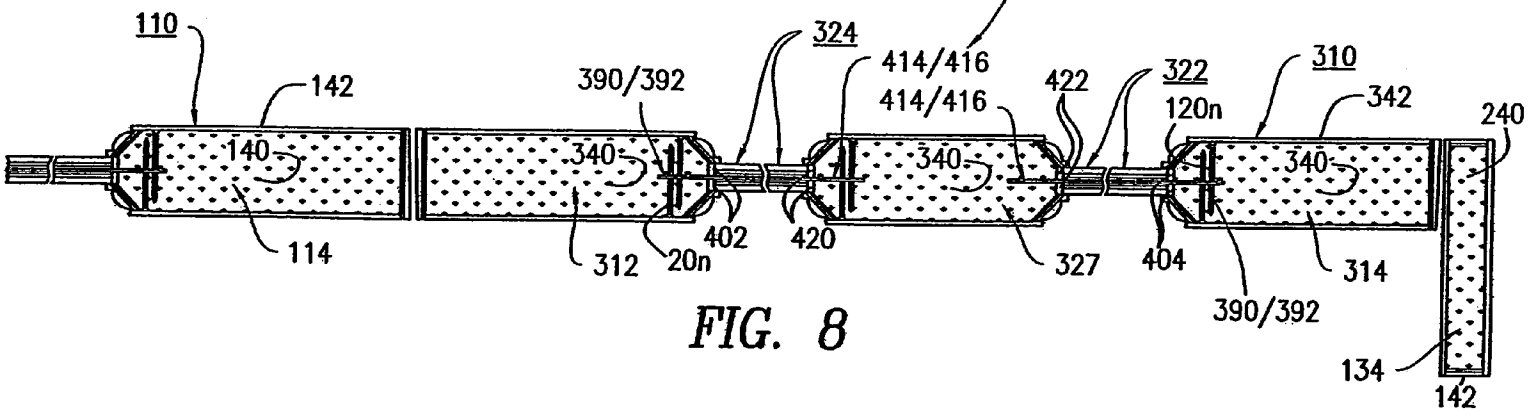
FIG. 8 is a cross-sectional view of the fire retardant panel door and door frame of the present invention taken along lines 8—8 of FIG. 1 in the direction of the arrows showing the lower panel, an interior second raised panel, the interior second intermediate rail, and the opposing stiles of one of the doors being set within the door frame.
Figure 12:
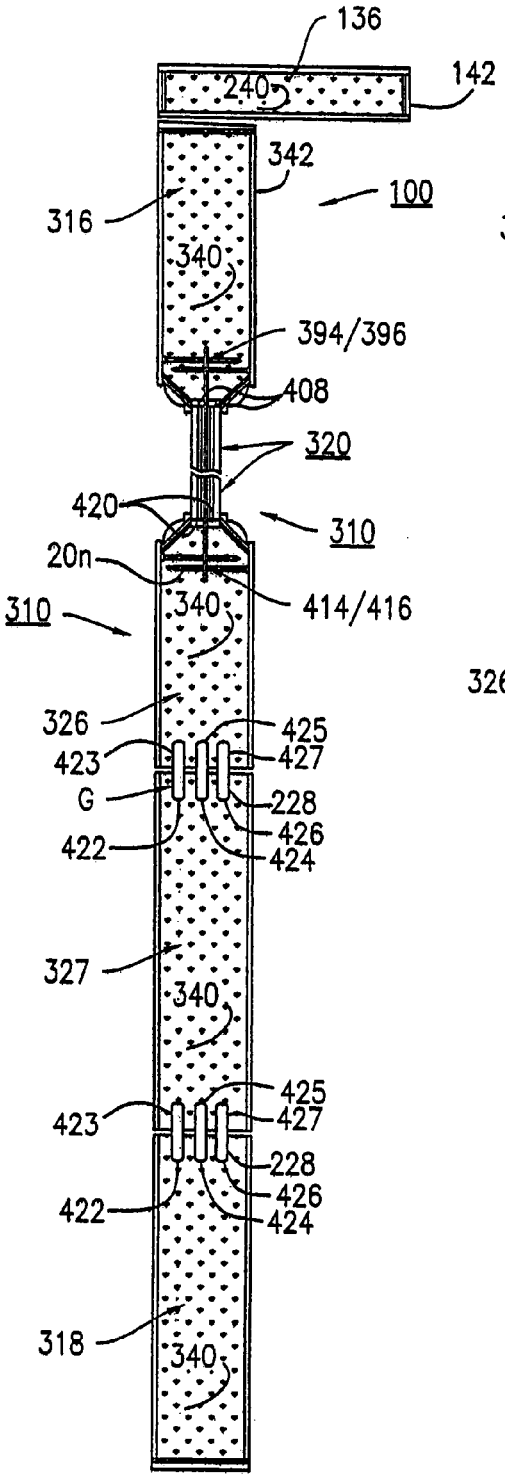
FIG. 12 is a cross-sectional view of the fire retardant panel door and door frame of the present invention taken along lines 12—12 of FIG. 1 in the direction of the arrows showing an upper panel connecting the opposite rails and the intermediate rails within the double door frame.

Tongue and groove joints 390 and 392 are used to connect upper panel 320 to stiles 312 or 314, respectively, and tongue and groove joints 394 and 396 are used to connect upper panel 320 to rail 316, as depicted in FIGS. 2, 4 and 11 of the drawings. Additionally, tongue and groove joints 414 and 416 are used to connect the first intermediate rail 326 to stiles 312 or 314, as well as the first intermediate rail 326 to upper panel 320, as depicted in FIG. 24. As shown in FIGS. 2, 4 and 11 the tongue and groove joints 390 and 392 include air gaps 402 and 404 for expansion of the intumescent material layers 378, 382, 384, and 388 in the presence of excessive heat and/or fire, such that the intumescent material layers 378, 382, 384, and 388 close the air gaps 402 and 404 within the fire retardant panel door 310 in order to prevent the spread of excessive heat and/or fire through the fire retardant panel door 310 and door frame 130. It is understood that the intumescent on the top of core material (See FIG. 14: 152*b*, 154*b*, 152*c* and 154*c*) provide thermal insulation to the panel joint, such that air gaps 204 (See FIG. 14) is for normal expansion and contraction that is associated with everyday performance of the wooden doors 110 and 310, as well as for the normal expansion and contraction of the wooden doors associated with air gaps 402, 404, 408, 410, 414, 416, 420 and 422. The FYRE ROC™ product is inserted into a 1 inch deep by ⅛ of an inch wide (dado) groove with SIMPSON adhesive A to block each of the aforementioned air gaps and to secure the panels to stiles and rails. Further, the tongue and groove joints 394 and 396, as shown in FIGS. 11, 12, and 13 also include air gaps 408 and 410 for expansion of the intumescent material layers 378, 382, 384, and 388 in the presence of excessive heat and/or fire, such that the intumescent material layers 378, 382, 384, and 388 close and seal the air gaps 408 and 410 within the fire retardant panel door 310 in order to prevent the spread of excessive heat and/or fire through the fire retardant panel door 310 and door frame 130. Also, the tongue and groove joints 414 and 416 include air gaps 420 and 422 for expansion of the intumescent material layers 378, 382, 384, and 388 in the presence of excessive heat and/or fire, such that the intumescent material layers 378, 382, 384, and 388 close and seal the air gaps 420 and 422 within the fire retardant panel door 310 in order to prevent the spread of excessive heat and/or fire through the fire retardant panel door 310 and door frame 130. Also, the tongue and groove joints 390 and 392, 394 and 396, and 414 and 416 are attached to each other using a staple 120*s* or nail 120*n*, respectively, as shown in FIGS. 22 and 24 of the drawings, as well as using Simpson ISR 70-07 adhesive on tongue members 390, 394 and 414 within grove channels 392, 396 and 416, respectively. Tongue members 390, 394 and 416 are made from the third and fourth middle fire resistant barrier layers 382 and 384 (FYRE ROC™ fire resistant barrier intumescent laminate sheet). Further, each of the rails 316 and 318, and stiles 312 and 314 include a dowel groove 422, 423, 424, 425, 426 and 427 respectively, for receiving the plurality of brass dowels 228, therein. Dowels 228 are used for additionally joining together the rails 316 and 318 to the stiles 312 and 314, respectively, as well as for additionally joining together stile 312 to intermediate rail 328, intermediate rail 328 to intermediate rail 327, intermediate rail 318 to intermediate rail 327 and intermediate rail 327 to intermediate rail 326 as shown in FIGS. 3, 5, 7 and 9. The brass dowels 228 are held in place within dowel grooves 422, 423, 424, 425, 426 and 427 with appropriate Resourcinol™ glue G, as shown in FIGS. 7 and 9.

OPERATION OF THE PRESENT INVENTION

In operation, when fire or excessive heat occurs, the intumescent materials expand and provide closing and sealing of all the tongue and groove joints within panel doors 110 and 310 as well as thermal insulation to thin areas within panel doors 110 and 310, respectively, of the double door assembly 100 of the preferred embodiment. This includes also the closing and sealing of the as perimeter edges of the fire retardant panel doors 110 and 310 within the door frame 130 respectively, thus preventing the spread of the fire through the fire retardant panel door 110 and 310 and door frame 130, respectively.

The fire retardant panel doors 110 and 310 and the door frame 130, respectively, of this invention have undergone special testing by I.T.S. Warnock Hersey Laboratory for fire resistance and have passed the fire burn test known as ANSI/U.L. 10B1978 including the hose stream test. By passing this fire burn test, the doors 110 and 310 and the door frame 130 respectively, can be specified by architects for many building uses where metal doors and wood flush doors would have been previously used.

The I.T.S. test under ANSI/U.L. 10B1978 includes the following steps:

1. The door structure to be tested is placed within a steel studded and gypsum wall.

2. One side of the door is subjected to an intense fire on a time temperature curve from 0 to 90 minutes and room temperature to 1785° F. temperature. More specifically, the time-temperature is as follows:

| |
|---|
| Start: Room temperature |
| 5 minutes: 1000° F. |
| 10 minutes: 1300° F. |
| 20 minutes: 1462° F. |
| 30 minutes: 1550° F. |
| 40 minutes: 1620° F. |
| 50 minutes: 1650° F. |
| 60 minutes: 1700° F. |
| 70 minutes: 1750° F. |
| 80 minutes: 1785° F. |
| 90 minutes: 1785° F. |

3. Immediately after the 90 minute burn period, the burned side of the door is subjected to a hose stream test from: a) a 2½ inch water supply hose; b) discharged through a tapered nozzle with a one (1) inch outlet opening; c) regulated to a 30 PSI discharge pressure; d) applied a distance of 20 feet from the door structure; and e) the time period of application of the water stream against the middle and all exposed parts of the door structure is controlled at a rate of 1.5 seconds per square foot.

The door being tested passes this testing procedure if no door panel or door members are disengaged from the supporting door frame assembly and if no openings are created.

In summary, the fire retardant panel doors 110 and 310 and the door frame 130, respectively, of the present invention have passed a ninety (90) minute burn test performed by a I.T.S. testing laboratory to obtain and meet the fire resistant specification known as the ANSI/U.L. 10B fire burn test for doors.

ADVANTAGES OF THE PRESENT INVENTION

Accordingly, it is an advantage of the present invention that it provides a reinforced fire retardant panel door and door frame that prevents buckling of the door during a fire.

Another advantage of the present invention is that it provides for a reinforced fire retardant panel door and door frame that has supplemental fire resistant materials strategically embedded and placed within the tongue and groove joints of the fire resistant panel door, as well as supplemental fire resistant materials placed on the perimeter edges of the fire resistant panel door for preventing the spread of fire through the door and door frame Another advantage of the present invention is that is provides for a reinforced fire retardant panel door and door frame that has intumescent and fire resistant material layers within the panel door and door frame for preventing the spread of fire through the door and door frame.

Another advantage of the present invention is that it provides for a reinforced fire retardant panel door and door frame that has fire resistant materials being multiple layers of intumescent material that expands in the presence of fire such that the intumescent material closes and seals the component tongue and groove joints, as well as the perimeter edges of the fire retardant panel door for preventing the spread of fire through the door and door frame.

Another advantage of the present invention is that it provides for a reinforced fire retardant panel door and door frame that is used as part of an interior or exterior personal living space, or workspace being installed within home dwellings, commercial buildings or industrial plants.

Another advantage of the present invention is that it provides for a reinforced panel door and door frame that has improved aesthetic qualities by having a minimum panel thickness of 7/16 of an inch allowing for a minimum thickness of 1¾ inches of the fire resistant and reinforced panel door which allows for greater profiling (depth) of the exterior wood molding between the center panel and the stiles and rails.

Another advantage of the present invention is that it provides for a reinforced fire retardant panel door and door frame that is aesthetically pleasing having the appearance of natural wood, and has achieved a successful fire rating of at least 90 minutes and passes a positive pressure test, and is easily installed in a building.

A further advantage of the present invention is that it provides for a reinforced fire retardant panel door and door frame that can be mass produced in an automated and economical matter and is readily affordable to the builder or consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A fire retardant panel door, comprising:

a) a panel door having at least one door panel and stiles and rails;

b) said door panel including an interior composite section formed by a first plurality of layers of intumescent materials and a first plurality of layers of fire resistant materials disposed between and laminated to a first pair of outer coverings to form a composite laminated door panel;

c) each of said stiles including a first core formed of an incombustible material and a second plurality of layers of intumescent materials and a second outer covering to form a composite laminated stile;

d) each of said rails including a second core formed of an incombustible material and a third plurality of layers of intumescent materials and a third outer covering to form a composite laminated rail;

e) said first, second, and third plurality of layers of intumescent materials being activated to expand upon exposure to heat and/or fire to prevent the heat and/or fire from passing through said at least one door panel, said stiles and said rails of said panel door during a fire for at least 90 minutes; and f) said at least one door panel being connected to said panel door by joints; and said joints having a fourth plurality of layers each comprising intumescent and fire resistant materials, wherein said fourth plurality of layers of intumescent and fire resistant materials in said joints being activated to expand upon exposure to heat and/or fire to seal said joints in order to prevent the heat and/or fire from passing through said panel door during a fire for at least 90 minutes.

2. A fire retardant panel door in accordance with claim 1, wherein said first plurality of layers of intumescent materials includes two intumescent layers and said first plurality of layers of fire resistant materials includes two fire resistant barrier layers for forming said interior composite section of said at least one door panel.

3. A fire retardant panel door in accordance with claim 2, wherein at least one of said two intumescent layers includes sodium silicate; and wherein at least one of said two fire resistant barrier layers includes a fire resistant metallo alumino silicate resin of said interior composite section of said at least one door panel.

4. A fire retardant panel door in accordance with claim 1, wherein said second plurality of layers of intumescent materials includes at least two intumescent layers on said first incombustible core of said composite laminated stile.

5. A fire retardant panel door in accordance with claim 4, wherein at least one of said at least two intumescent layers includes thermally expanded graphite of said composite laminated stile.

6. A fire retardant panel door in accordance with claim 1, wherein said third plurality of layers of intumescent materials includes at least two intumescent layers on said second incombustible core of said composite laminated rail.

7. A fire retardant panel door in accordance with claim 6, wherein at least one of said at least two intumescent layers includes thermally expanded graphite of said composite laminated rail.

8. A fire retardant panel door in accordance with claim 1, wherein said fourth plurality of layers of intumescent materials includes two intumescent and fire resistant layers for forming a third composite of said two intumescent and fire resistant layers within a tongue section of said joints of said door panel.

9. A fire retardant panel door in accordance with claim 8, wherein at least one of said two intumescent and fire resistant layers includes a fire resistant metallo alumino silicate resin of said tongue section.

10. A fire retardant panel door in accordance with claim 1, wherein at least one layer of each of said first, second and third plurality of layers of intumescent materials is made from a sodium silicate; and wherein at least one layer of each of said first and fourth plurality of layers of intumescent and fire resistant materials is made from a fire resistant metallo alumino silicate resin.

11. A fire retardant panel door in accordance with claim 1, wherein said first pair of outer coverings is made from wood applique selected from the group consisting of oak, maple, walnut, poplar, pine and other hardwoods.

12. A fire retardant panel door in accordance with claim 1, wherein said first plurality of layers of intumescent materials, said first plurality of layers of fire resistant materials, and said first pair of outer coverings of wood are laminated together using adhesive and pressure to form said composite laminated door panel.

13. A fire retardant panel door in accordance with claim 1, wherein said first incombustible core of said stile is made from a mineral core.

14. A fire retardant panel door in accordance with claim 1, wherein said second outer covering of said stile is made from wood applique selected from the group consisting of oak, maple, walnut, poplar, pine and other hardwoods.

15. A fire retardant panel door in accordance with claim 1, wherein said first incombustible core, said second plurality of layers of intumescent materials, and said second outer covering are laminated together using adhesive and pressure to form said composite laminated stile.

16. A fire retardant panel door in accordance with claim 1, wherein said second incombustible core of said rail is made from a mineral core.

17. A fire retardant panel door in accordance with claim 1, wherein said third outer covering of said rail is made from wood applique selected from the group consisting of oak, maple, walnut, poplar, pine and other hardwoods.

18. A fire retardant panel door in accordance with claim 1, wherein said second incombustible core, said third plurality of layers of intumescent materials, and said third outer covering are laminated together using adhesive and pressure to form said composite laminated rail.

19. A fire retardant panel door in accordance with claim 1, wherein said joints are tongue and groove joints.

20. A fire retardant panel door in accordance with claim 19, wherein said tongue and groove joints each include a tongue section and a groove section.

21. A fire retardant panel door in accordance with claim 20, wherein each of said tongue sections and groove sections are held together by attachment means.

22. A fire retardant panel door in accordance with claim 21, wherein said attachment means includes a staple and/or a nail through said tongue section and a groove section of said tongue and groove joints.

23. A fire retardant panel door in accordance with claim 19, wherein said tongue and groove joints include first air gaps between said first plurality of layers of intumescent materials of said door panel and said second plurality of layers of intumescent materials of said stile for expansion of said first and second plurality of layers of intumescent materials within said first air gaps upon exposure to heat and/or fire to seal said tongue and groove joints in order to prevent the heat and/or fire from passing through said door panel and said stile during a fire.

24. A fire retardant panel door in accordance with claim 19, wherein said tongue and groove joints include second air gaps between said first plurality of layers of intumescent materials of said door panel and said third plurality of layers of intumescent materials of said rail for expansion of said first and third plurality of layers of intumescent materials within said second air gaps upon exposure to heat and/or fire to seal said tongue and groove joints in order to prevent the heat and/or fire from passing through said door panel and said rail during a fire.

25. A fire retardant panel door in accordance with claim 19, wherein said tongue and groove joints include third air gaps between said second plurality of layers of intumescent materials of said stile and said third plurality of layers of intumescent materials of said rail for expansion of said second and third plurality of layers of intumescent materials within said third air gaps upon exposure to heat and/or fire to seal said tongue and groove joints in order to prevent the heat and/or fire from passing through said stile and said rail during a fire.

26. A fire retardant panel door in accordance with claim 1, wherein said panel door includes perimeter edging having said second and third plurality of layers of intumescent materials therein which expand upon exposure to heat and/or fire to seal said perimeter edging relative to a door frame in order to prevent the heat and/or fire from passing through said panel door and said door frame during a fire.

27. A fire retardant panel door in accordance with claim 26, wherein said door frame includes jambs and an upper header.

28. A fire retardant panel door in accordance with claim 27, wherein each of said jambs includes a fourth core formed of an incombustible enclosed by a sixth plurality of layers of intumescent materials enclosed by a fifth outer covering to form a composite laminated jamb.

29. A fire retardant panel door in accordance with claim 28 wherein said sixth plurality of layers of intumescent materials includes at least one intumescent layer within said composite laminated jamb.

30. A fire retardant panel door in accordance with claim 29, wherein at least one of said intumescent layers includes thermally expanded graphite on said fourth incombustible core of said composite laminated jamb.

31. A fire retardant panel door in accordance with claim 28, wherein said fourth incombustible core of said jamb is made from a mineral core.

32. A fire retardant panel door in accordance with claim 28, wherein said fifth outer covering of said jamb is made from a wood applique selected from the group consisting of oak, maple, walnut, poplar, pine and other hardwoods.

33. A fire retardant panel door in accordance with claim 28, wherein said fourth incombustible core, said sixth plurality of layers of intumescent materials and said fifth outer covering are laminated together using adhesive and pressure to form said composite laminated jamb.

34. A fire retardant panel door in accordance with claim 27, wherein said upper header includes a fifth core formed of an incombustible material enclosed by a seventh plurality of layers of intumescent materials are enclosed by a sixth outer covering to form a composite laminated upper header on said door frame.

35. A fire retardant panel door in accordance with claim 34, wherein said seventh plurality of layers of intumescent materials includes at least one intumescent layer within said composite laminated upper header.

36. A fire retardant panel door in accordance with claim 34, wherein said fifth incombustible core of said upper header is made from a mineral core.

37. A fire retardant panel door in accordance with claim 34, wherein said sixth outer covering of said upper header is made from wood applique selected from the group consisting of oak, maple, walnut, poplar, pine and other hardwoods.

38. A fire retardant panel door in accordance with claim 34, wherein said fifth incombustible core, said seventh plurality of layers of intumescent materials and said sixth outer covering are laminated together using adhesive and pressure to form said composite laminated upper header.

39. A fire retardant panel door in accordance with claim 34, wherein said door frame includes perimeter surface walls having said sixth and seventh plurality of layers of intumescent materials therein which expand upon exposure to heat and/or fire to seal said perimeter surface walls within said door frame in order to prevent the heat and/or fire from passing through said panel door and said door frame during a fire.

40. A fire retardant panel door in accordance with claim 1, wherein said at least one door panel includes one or more intermediate rails for separating two or more door panels of said panel door.

41. A fire retardant panel door in accordance with claim 40, wherein each of said intermediate rail includes a third core formed of an incombustible material enclosed by a fifth plurality of layers of intumescent materials and a fourth outer covering to form a composite laminated intermediate rail.

42. A fire retardant panel door in accordance with claim 41 wherein said fifth plurality of layers of intumescent materials includes at least two intumescent layers on said third incombustible core of within said composite laminated intermediate rail.

43. A fire retardant panel door in accordance with claim 42, wherein at least one of said at least two intumescent layers includes thermally expanded graphite within said composite laminated intermediate rail.

44. A fire retardant panel door in accordance with claim 41 wherein said third incombustible core of said intermediate rail is made from a mineral core.

45. A fire retardant panel door in accordance with claim 41 wherein said fourth outer covering of said intermediate rail is made from wood applique selected from the group consisting of oak, maple, walnut, poplar, pine and other hardwoods.

46. A fire retardant panel door in accordance with claim 40, wherein said third incombustible core, said fifth plurality of layers of intumescent materials, and said fourth outer covering are laminated together using adhesive and pressure to form said composite laminated intermediate rail.

47. A fire resistant panel door in accordance with claim 1, wherein said first pair of coverings of said composite laminated door panel is made of metal materials selected from the group consisting of steel, stainless steel and aluminum.

48. A fire retardant panel door in accordance with claim 1, further including a double door assembly having a first panel door with one or more door panels, stiles, and rails, and having a second panel door with one or more door panels, stiles, rails, and intermediate rails within a double door frame.

49. A fire retardant panel door in accordance with claim 1, wherein said first plurality of layers of intumescent materials includes two intumescent layers and wherein said first plurality of layers of fire resistant materials includes at least one fire resistant barrier layer for forming said interior composite section.

50. A fire retardant panel door in accordance with claim 1, wherein said interior composite section includes a first interior composite section and a second interior composite section.

51. A fire retardant panel door in accordance with claim 50, wherein each of said first and second interior composite sections are separately stapled and glued together.

* * * * *